US006047435A

United States Patent [19]

Suzuki et al.

[11] Patent Number: 6,047,435

[45] Date of Patent: Apr. 11, 2000

[54] CLEANING CLOTH AND CLEANING APPARATUS

[75] Inventors: Youichi Suzuki; Keiji Abe; Yasuki Tsutsumi; Sachiko Aoki, all of Tochigi; Fumihiko Yoshiro, Tokyo; Harunobu Hirayama, Tokyo; Masahito Hanaoka, Tokyo, all of Japan

[73] Assignee: Kao Corporation, Tokyo, Japan

[21] Appl. No.: 09/340,042

[22] Filed: Jun. 28, 1999

Related U.S. Application Data

[62] Division of application No. 08/983,504, filed as application No. PCT/JP96/02141, Jul. 30, 1996.

[30] Foreign Application Priority Data

Aug. 1, 1995 [JP] Japan ..... 7-196702
Dec. 18, 1995 [JP] Japan ..... 7-320790

[51] Int. Cl.[7] ..... A47L 13/20

[52] U.S. Cl. ..... 15/229.8; 15/228; 15/229.4

[58] Field of Search ..... 15/209.1, 210.1, 15/228, 229.1, 229.2, 229.3, 229.4, 229.6, 229.7, 229.8, 172

[56] References Cited

U.S. PATENT DOCUMENTS 2,816,313 12/1957 Beck et al. .
3,196,475 7/1965 Brown .
3,221,356 12/1965 Schirmer .
3,528,076 9/1970 Anderson .
4,114,224 9/1978 DIsko .
4,313,774 2/1982 Arthur .
4,510,640 4/1985 Omori .
4,788,735 12/1988 Fuk Fan .
4,829,622 5/1989 O'Sullivan .
4,995,133 2/1991 Newell ..... 15/228
5,452,491 9/1995 Thompson ..... 15/229.4
5,477,582 12/1995 Yamashita .

FOREIGN PATENT DOCUMENTS 2663832 1/1992 France .
634773 9/1994 Japan .
78434 1/1995 Japan .

*Primary Examiner*—Terrence R. Till
*Attorney, Agent, or Firm*—Birch, Stewart, Kolasch & Birch, LLP

[57] ABSTRACT

A cleaning apparatus includes a handle for a cleaning cloth to be attached thereto, and a flat bag-like cleaning cloth having an insertion space therein. The handle is provided at a front end portion of a handle body with a head portion. The head portion is inserted into the insertion space, thereby attaching the cleaning cloth to the head portion. The cleaning cloth includes a joined portion formed by joining non-woven fabrics together and having a flat bag-like configuration defining an insertion space in the internal area of the cleaning cloth and a non-joined portion being provided at an external area of the joined portion.

10 Claims, 24 Drawing Sheets

CLEANING CLOTH AND CLEANING APPARATUS

This application is a divisional of co-pending application Ser. No. 08/983,504, filed on Feb. 23, 1998. Application Ser. No. 08/983,504 is the national phase of PCT International Application No. PCT/JP96/02141 filed on Jul. 30, 1996 under 35 U.S.C. §371. The entire contents of each of the above-identified applications are hereby incorporated by reference.

TECHNICAL FIELD

This invention relates to a dry type bag-like cleaning cloth made of a cleaning sheet, and a cleaning apparatus to which the cleaning cloth is attached.

BACKGROUND ART

Recently, a cleaning apparatus was proposed as a device for cleaning or cleaning a room, etc. This cleaning apparatus is more quiet in operation and more handy than a vacuum cleaner. This cleaning apparatus is made of a dry type cleaning sheet which requires no water as required in the case with an ordinary floor-cloth. Examples of such a cleaning apparatus heretofore proposed include a cleaning apparatus in which a fixture plate is mounted on an end portion of its handle and a disposable cleaning sheet is attached to the fixture plate (see Japanese Patent Application Laid-Open 7-8434), and a cleaning apparatus in which a cushion material is employed as a cleaning cloth (see Japanese Utility Model Publication 6-34773).

The conventional cleaning apparatuses are suitable to clean an area which is open and wide, but they are inadequate to clean a limited space such as a space between adjacent keys of a keyboard, a space between adjacent operating buttons of various types of OA devices, and the like. Furthermore, the conventional cleaning apparatuses have such inconveniences that since the cleaning sheet is required to have an overlap width for attaching to the fixture plate and the overlap width cannot exhibit the cleaning function, it is economically inefficient.

Moreover, the conventional cleaning apparatuses have such problems in that if a head portion is too soft or flexible, an end of the head portion, which is readily deformed in accordance with the configuration of an object to be cleaned, is susceptible to fatigue and therefore, it becomes difficult to completely remove dirty things such as dusts, etc., firmly stuck to the head portion. In contrast, if the head portion is too hard, intimate attachability of the head portion to the object to be cleaned is degraded. It makes it difficult for the cleaning apparatus to exhibit its full cleaning effect. Sometimes, there is the fear that the hard head portion damages the object to be cleaned and/or the cleaning cloth is torn during a cleaning operation.

If it is possible in such conventional cleaning apparatuses to prevent a part of the cleaning cloth from becoming dirty, it becomes convenient for their user because the user can turn the cleaning cloth inside out or detach it, where necessary, from the head portion by picking up the clean part of the cleaning cloth.

Also, in such conventional cleaning apparatuses, it will be convenient if the used surface of the cleaning cloth can easily be switched to a non-used surface.

As known home-use cleaning apparatuses for wiping out dusts attached to articles such as furniture, electrical devices, illuminating instruments, etc., there are dusters having a plurality of wire-like elements arranged on an end portion of the head. These conventional dusters have the role for dusting and wiping out dusts attached to the surface of the object to be cleaned.

Since the conventional dusters are designed chiefly for the use as mentioned above, it is difficult for them to fully wipe out dusts which are attached to a wide area of the object.

SUMMARY OF THE INVENTION

It is, therefore, a first object of the present invention to provide a cleaning cloth which can suitably be used for cleaning even a limited space, and to provide a cleaning apparatus which is economically efficient.

It is a second object of the present invention to provide a cleaning apparatus, in which a head portion has an excellent shape retention, firmly-attached dirt can fully be removed, intimate attachability of the head portion to an object to be cleaned is good, and there is no fear that an object to be cleaned will be damaged and a cleaning cloth will be torn during a cleaning operation.

It is a third object of the present invention to provide a cleaning apparatus, in which its user can replace the cleaning cloth without a need of picking up the dirty area of the cleaning cloth.

It is a fourth object of the present invention to provide a cleaning apparatus, in which a used part of a cleaning cloth can easily be switched to a non-used part.

It is a fifth object of the present invention to provide a novel cleaning cloth, a novel cleaning apparatus to which the cleaning cloth is attached, which can suitably be used not only as a duster but also for a cleaning operation.

The first to fifth objects of the present invention mentioned above can be accomplished by any one of the cleaning cloths and the cleaning apparatuses according to the present invention described below, or by any one of the embodiments thereof as later described.

A cleaning cloth is disclosed having a joined portion formed by joining nonwoven fabrics together and having a flat bag-like configuration defining an insertion space in the internal area of the cleaning cloth, wherein a non-joined portion is provided at an external area of the joined portion.

A cleaning apparatus is disclosed comprising a handle to be attached to a cleaning cloth and a flat bag-like cleaning cloth having an insertion space therein, the handle being provided with a head portion at an end portion of a handle body, said head portion being inserted into said insertion space thereby attaching said cleaning cloth to said head portion.

A cleaning apparatus is disclosed having a head portion to which a cleaning cloth is attached, the head portion being provided at a front end portion of a handle, wherein the C-hardness of the head portion is in a range of from 1 to 60 inclusive.

A cleaning apparatus is disclosed having a head portion to which a cleaning cloth is attached, the head portion being provided at a front end portion of a handle, wherein the head portion or handle is provided with a fixing portion for fixing said cleaning cloth.

A cleaning apparatus is disclosed having a head portion to which a cleaning cloth is attached, the head portion being provided at a front end portion of a handle, wherein the head portion is able to be turned upside down while the head portion is attached to the handle.

A cleaning cloth is disclosed including a planar cleaning portion composed of a fibrous material and a strip-like or pile-like dusting portion composed of a fibrous material.

A cleaning apparatus is disclosed having a head portion to which a cleaning cloth is attached, the head portion being provided at a front end portion of a handle, wherein the head portion has an elongated shape and a flat configuration in which the thickness thereof is smaller than the width thereof, a forward portion of the head portion being configurated such that at least the upper surface thereof forms a tilt surface inclined toward the front end portion of the head portion, and the tilt surface and the bottom surface thereof making an acute angle at the front end portion, said head portion is connected at the backward portion thereof to the front end portion of said handle such that said forward portion of said head portion is aligned with the longitudinal direction of said handle, said handle is configurated such that said handle has a grip portion located above the upper surface of said head portion, and a fixing portion for fixing a cleaning cloth to be attached to said head portion is provided with said head portion or in the vicinity of said front end portion of said handle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein:

FIG. 6*a* is a plan view, and FIG. 6*b* is a bottom view;

FIG. 13*a* is a view showing a state in which a handle body and the head portion are separated from each other, FIG. 13*b* is a view showing a state in which the head is attached to the handle body, and FIG. 13*c* is a view showing a state in which the handle body is stretched;

FIG. 14*a* is a plan view, and FIG. 14*b* is a plan sectional view;

FIG. 16*a* is a perspective view showing a state that the cleaning cloth is not attached yet, and FIG. 16*b* is a perspective view showing a state that the cleaning cloth is already attached to the head portion;

FIG. 17*a* is a perspective view in which a tag of the cleaning cloth is detached from the head, and FIG. 17*b* is a perspective view in which the cleaning cloth is going to be removed from the head;

FIG. 20*a* is a side view showing a state in which a cleaning cloth is removed from the cleaning apparatus, and FIG. 20*b* is a perspective view showing a head portion being turned upside down with respect to the handle;

FIG. 22*a* is a perspective view in which a grip portion of a handle is brought to an upper location with respect to the head, FIG. 22*b* is a perspective view in which the handle is stretched horizontally with respect to the head, and FIG. 22*c* is a perspective view in which the grip portion of the handle is brought to a lower location;

FIG. 23*b* is a view like FIG. 23*a* showing another sectional configuration of the head portion, FIG. 23*c* is a view like FIG. 23*a* showing another sectional configuration of the head portion, and FIG. 23*d* is a view like FIG. 23*a* showing another sectional configuration of the head portion;

FIG. 24*a* is a perspective view, in which a head portion is attached to a handle body, FIG. 24*b* is a perspective view in which the handle body and the head portion are separated from each other and the head portion is placed upside down;

FIG. 26*a* is a plan view showing an embodiment of the head portion, and FIG. 26*b* is a perspective view showing another embodiment of the head portion;

FIG. 27*a* is a plan sectional view showing a main portion of a form of the head portion and the core member, FIG. 27*b* is a plan sectional view showing a main portion of another form of the head portion and the core member, and FIG. 27*c* is a plan sectional view showing a main portion of a still another form of the head portion and the core member;

FIG. 28*a* is a plan view showing one of the embodiments thereof, FIG. 28*b* is a plan view showing another one of the embodiments thereof, FIG. 28*c* is a plan view showing still another one of the embodiments, and FIG. 28*d* is a plan view showing yet another one of the embodiments thereof;

FIG. 29*a* is a perspective view of the cleaning apparatus to which the cleaning cloth is not attached, and FIG. 29*b* is a perspective view of the cleaning apparatus to which the cleaning cloth is attached;

FIG. 30*a* is a perspective view of the cleaning apparatus to which the cleaning cloth is not attached yet, and FIG. 30*b* is a perspective view of the cleaning apparatus to which the cleaning cloth is already attached;

FIG. 31*a* is a back view, FIG. 31*b* is a side view, FIG. 31*c* is a plan view, and FIG. 31*d* is a bottom view;

FIG. 32*a* is a plan view showing one of the embodiments thereof, and FIG. 32*b* is a plan view showing the other one of the embodiments thereof; FIG. 33*a* is a plan view showing an embodiment the core member, FIG. 33*b* is a plan view showing another embodiment of the core member, and FIG. 33*c* is a plan view showing still another embodiment of the core member.

DETAILED DESCRIPTION OF THE PREFERRED EMBODIMENTS

Figure 1:
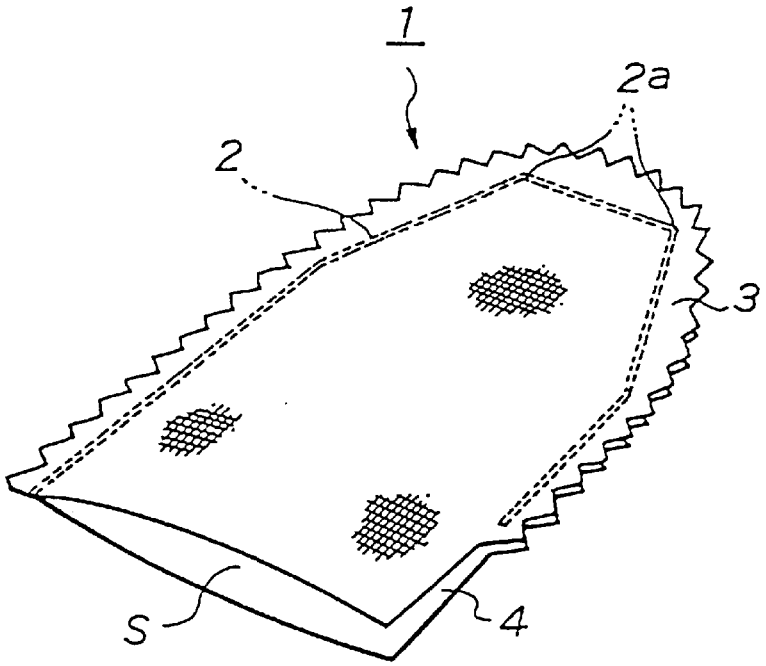
FIG. 1 is a perspective view showing an embodiment A of a cleaning cloth according to the present invention.

Several embodiments of the present invention will now be described with reference to the accompanying drawings.

A typical example of a cleaning cloth according to the present invention is of the type in which non-woven fabrics are bonded together to form a bonded portion, an insertion space being defined at an internal area of the bonded portion (joined portion), thereby a flat bag-like configuration being formed as a whole, a non-bonded portion (non-joined portion) being provided at an external area of the bonded portion.

Thus, the joined portion in the cleaning cloth according to the present invention is preferably constituted as a bonded portion obtained by heat sealing or the like. However, the joined portion is not limited to a bonded portion so long as the non-woven fabrics are joined to each other, and therefore the joined portion may be formed by sewing or the like.

The non-woven fabric constituting the cleaning cloth is preferably a non-woven fabric composed of a fibrous material which is excellent in dust absorbing properties and anti-wear properties. Examples of such a non-woven fabric preferably include a spun lace non-woven fabric, a spun bonded non-woven fabric, a suction non-woven fabric, a heat bonded non-woven fabric, a melt brown non-woven fabric and the like.

The fibrous composition for composing the non-woven fabric can suitably selected depending on the bonding method. In case the cleaning cloth is formed by heat sealing the non-woven fabric as later described, it is preferred that a non-woven fabric made of a polyethylene terephthalate (PET) fiber is used, for example, on the cleaning surface side and a non-woven fabric made of a PET/polyethylene (PE) (core/sheath) composite fiber is used on the bonding surface side. These non-woven fabrics are preferably obtained by subjecting a polypropylene (PP) fiber to water needling through a PP net having a lattice shape arrangement. In that case, it is preferred especially for the PET/PE (core/sheath) composite fiber, which composes the non-woven fabric used on the bonding surface side, to include 10 to 90 wt % of PE.

The cleaning cloth of the present invention may take any form as long as it can exhibits a flat bag-like configuration having an insertion space therein. Examples of such a form are preferably a form obtained by placing two non-woven fabrics one upon the other and then sealing them at an area having a predetermined width to thereby form a bonded portion, a form obtained by folding a single non-woven fabric, then sealing it at other areas having a predetermined width than the folded portion to thereby form a bonded portion, and then forming the same into a flat bag-like configuration having an insertion space which corresponds to the configuration of the head portion. Especially, the arrangement for forming the insertion space in a way to correspond to the configuration of the head portion proves to be effective because an entire area of the cleaning cloth secured to a fixture portion, only excepting an area in the vicinity of an opening portion thereof, can all be used.

The style how to form the bonded portion is preferably decided depending on what form the head portion takes. For example, it is preferred that the end portion includes an angular portion, or the bonded portion is formed into a U-shape, a V-shape, or the like in a plan view. Aside from various sealing methods, the bonded portion may be formed by sewing. In case the bonded portion is formed by sealing, the width is arranged to be from 20 mm to 0.1 mm, and preferably from 10 mm to 1 mm. Owing to this arrangement, a desired strength can be obtained. Acceptable sealing methods include a supersonic sealing method, a sealing method utilizing a hot melt adhesive, a heat sealing method, and the like. The sealing pattern for forming the bonded portion by one of these sealing methods is not particularly limited. Sealing patterns preferably include, for example, a solid, a stripe, dots, and the like. In case the bonded portion (joined portion) is formed by sewing, it is preferred that an ordinary sewing method utilizing a sewing machine or the like is employed.

The width of the non-bonded portion located at an external area of the bonded portion is, in case the bonded portion is formed by the sealing method, from 1 mm to 50 mm, and preferably from 5 mm to 30 mm from the peripheral edge portion of the non-woven fabric. If the width is smaller than 1 mm, the object to be cleaned is easily damaged by the bonded-portion thus sealed. Moreover, the non-bonded portion can hardly exhibit its dust absorbing effect. In contrast, if the width is larger than 50 mm, the non-bonded portion lacks stiffness, thus making it difficult to be used for cleaning. In case the bonded portion is formed by sewing, the width is from 1 mm to 50 mm and preferably from 5 mm to 30 mm from the peripheral edge portion of the non-woven fabric. If the width is smaller than 1 mm, the sewing thread tends to be tangled. Moreover, the non-bonded portion can hardly exhibit its dust absorbing effect. In contrast, if the width is larger than 50 mm, the non-bonded portion lacks stiffness, thus making it difficult to be used for cleaning.

It is preferred that the non-bonded portion is located at an external side of the bonded portion in such a manner as to correspond to the bonded portion. In case the cleaning cloth is formed of two non-woven fabrics as previously mentioned, the non-bonded portion is provided over the entire periphery of the cleaning cloth excepting the area of the opening portion. On the other hand, in case the cleaning cloth is formed like a bag from a single non-woven fabric, the non-bonded portion is preferably provided on a part of the peripheral edge portion of the cleaning cloth. Although it is preferred that the non-bonded portion is provided in such a manner as to correspond to the bonded portion, it may be provided at an external side of the bonded portion. The style of the external edge portion of the bonded portion is not particularly limited. In view of effective attachment of dust, etc., however, the style is preferably a continuous chevron (serrated) cut, for example.

The provision of at least one slit in the opening portion of the cleaning cloth is effective in view of achieving an easy attachment and detachment of the cleaning cloth. In that case, the length of the slit is preferably in a range from approximately 10 mm to 70 mm.

Embodiments of a cleaning apparatus according to the present invention will now be described.

Throughout the present description, the term "cleaning apparatus" mostly refers to "a cleaning apparatus to which a cleaning cloth is attached", but there are some cases that it refers to "a cleaning apparatus in the state that the cleaning cloth is not attached (i.e., only its apparatus portion obtained by excluding the cleaning cloth from the cleaning apparatus)".

A cleaning apparatus according to the present invention comprises a handle having at its end portion a head portion, and a flat bag-like cleaning cloth having an insertion space therein. The head portion is usually made of a flexible material.

In the above cleaning apparatus, the cleaning cloth to be attached to the head portion is not limited to the bag-like cleaning cloth as long as it can be attached to the head portion. It is preferred, however, that the flat bag-like cleaning cloth of the present invention is employed, with the cleaning cloths of the embodiments A to D being particularly preferred.

The flexible material constituting the head portion is a sponge-like porous flexible material or rubber-like flexible material having a C-hardness of from 1 to 60 and preferably from 20 to 35. Here, the term "C-hardness" refers to the hardness measured by a rubber hardness meter C-type based on SRIS (Japan Rubber Institute Specification) 0101. If the C-hardness of the flexible material is smaller than the lower limit of the above-mentioned range, the end of the head portion, which is readily deformed in accordance with the configuration of an object to be cleaned, is susceptible to fatigue and therefore, it becomes difficult to completely remove dirty things such as dusts, etc., firmly stuck to the head portion. In contrast, if the C-hardness of the flexible material is larger than the upper limit of the above-mentioned range, intimate contact with the object to be cleaned is degraded, and a satisfactory cleaning operation cannot be obtained. Moreover, the object may easily be damaged and the cleaning cloth maybe readily torn during a cleaning operation.

In case the head portion is made of a sponge-like porous flexible material, it is particularly preferred that a porous material composed of a soft foamed synthetic resin having an excellent durability is employed. As a preferable porous soft material having such properties as just mentioned, there can be listed, for example, a synthetic resin such as a foamed polyethylene, a foamed polyurethane or the like.

In case the head portion is formed of a porous soft material made of a synthetic resin as mentioned above, in order to enhance a smooth attachment and detachment of the cleaning cloth, it is preferred that the head portion has a good surface lubricant or the head portion is subjected to surface treatment so that color change can be suppressed. As a method for enhancing a favorable surface lubricant, there can be listed, for example, a meltome treatment (treatment for enhancing a favorable surface lubricant), a mold coating treatment, or the like. As a surface treatment method for suppressing a color change, there can be listed, for example, an in-mold coating treatment, an application of an anti-yellowing treatment, coating, or the like.

As the soft material for composing the head portion, it is preferred to use, for example, a cushion-like soft material obtained by putting a fibrous material such as felt, cotton or the like into a bag made of an artificial leather or a fabric, aside from the sponge-like porous soft material.

It is preferred that the head portion is tapered such that the thickness of the head portion is decreased towards its end portion, or in the width direction thereof (for example, the sectional configuration is trapezoidal or like a convex lens). Owing to this arrangement, the thickness-reduced end portion or side edge portion is pressed against the corner portion or angular portion so that the cleaning cloth can be intimately contacted therewith. Accordingly, a corner portion where dirt and dust are readily stacked can reliably be cleaned. Although a lower surface portion (bottom surface portion) of the head portion is preferably flat, it may be, either partly or entirely, provided with irregularities.

The form of the head portion can be suitably changed depending on what cleaning cloth is attached. It is preferred, however, to use a head portion having an angular portion at its end portion. When the head portion is designed to have such a form as mentioned, a corner portion and a narrow space can easily be cleaned. Further, the head portion is tapered such that the thickness of the head portion is decreased towards its end portion, or in the width direction thereof (for example, the sectional configuration is trapezoidal or like a convex lens). With this feature, a corner portion can easily be cleaned, and a narrow space can easily be cleaned. The head portion may have a predetermined thickness.

It is preferred to arrange a core member within the head portion in order to apply a desired rigidity thereto. This arrangement of the core member within the head portion is particularly effective when the head is made of a porous flexible material or cushion-like flexible material.

The form of the core member can appropriately be changed depending on what form the head portion takes. The core member may be integral with the handle body or separately situated from the handle body.

In case the core member is separately situated from the handle body, it is preferred that the core member is made of a synthetic resin such as polypropylene, ABS, and polycarbonate, or metal such as stainless steel, and spring steel. In that case, it is preferred that an attachment means (for example, male-threaded member) for attaching the core member to the handle body is provided on a lower end portion of the core member.

In case the head portion is made of a porous flexible material or cushion-like flexible material as mentioned above, it is preferred that the core member is arranged within the head portion, but in case the head portion is made of a flexible resilient member such as a rubber, the core member may be omitted.

The provision of the catch portion for catching the inner surface of the cleaning cloth when the cleaning cloth is detached from the head portion, on a forward portion of the head portion is effective when the cleaning cloth is temporarily detached from the head portion for the purpose of using the back side of the cleaning cloth because the cleaning cloth can easily be turned inside out simultaneously when the cleaning cloth is detached from the head portion. The form of the catching portion is not particularly limited as long as it is capable of catching the inner surface of the cleaning cloth when the cleaning cloth is detached from the head portion. For example, a mechanical hook (for example, "MAGIC TAPE" of a registered trademark, the same hereinafter) may be attached to a forward portion of the head portion, or a plastic thin plate having a wedge-like erected-projection may be attached likewise with an end of the erected-projection facing backwardly, or a plastic thin plate having a comb-teeth like one end may be attached likewise with the one end facing backwardly. In case the head portion is made of a sponge-like porous flexible material, the catching portion may be formed by forming the head portion using a suitable mold so that the head portion itself may have a wedge-like projection.

The handle portion is preferably designed such that the head portion can be attached to an end portion of the handle portion and a grip portion is provided on a rear end portion of the handle, the grip portion being curved or bent so that the grip portion is higher than the head portion when the head portion is attached. It is preferred that the handle comprises a handle body having a grip portion, and a portion for the attachment of the head portion, and that these component parts can be assembled and disassembled.

The handle may or may not be expansible and contractible. If the handle is designed to be expansible and contractible when the handle is curved or bent in the manner as mentioned above, it is preferred that the grip portion is made expansible and contractible and engageable at a predetermined location, or the portion for the attachment of the head portion is made expansible and contractible and engageable at a predetermined location.

The handle is preferably made of vinyl chloride, polypropylene, ABS, poly-carbonate, aluminum or its alloy, wood, or bamboo in view of light-weight, strength and low-cost.

The head portion or the handle is provided with a fixture portion for fixing thereto the area in the vicinity of the opening portion of the cleaning cloth which is attached to the head portion. The fixture portion is designed to be depressed downwardly from the surface of the head portion, so that when the area in the vicinity of the opening portion of the cleaning cloth is secured to the fixture portion, the surface of the area in the vicinity of the opening portion of the cleaning cloth is depressed downwardly from the surface of the cleaning cloth which covers the surface of the head portion. The fixture portion is arranged such that when the cleaning cloth is attached for the first time and when the cleaning cloth is attached in its inside out posture, it can be secured at the same portion as the area in the vicinity of the opening portion of the cleaning cloth. Owing to this arrangement, it can be suppressed that dust, etc. adheres to the area in the vicinity of the opening portion which is secured to the fixture portion. In addition, it can be prevented that the fixture portion is adhered with dust, etc. or choked when the cleaning cloth is secured again after it is turned inside out, and that the hand gets dirty or the like when a fixing work is undergoing.

In case the fixture portion is provided at the handle, it is preferred that an opening portion or a cut-out portion is provided at a location facing the area in the vicinity of the opening portion of the cleaning cloth which is attached to the head portion at both upper and lower sides of the head portion, so that the fixture portion provided on the handle is exposed through the opening portion or the cut-out portion. Especially, in case the handle comprises the handle body portion and the attachment member as previously mentioned, the fixture portion is preferably arranged at the attachment member.

In case the fixture portion is provided at the head portion, it is preferred that a recess is formed in an area facing the vicinity of the opening portion of the cleaning cloth which is attached to the head portion and the fixture portion is disposed within the recess.

No limitation is imposed on the location where the fixing portion is disposed as long as it is a location where the cleaning cloth can be secured to the head portion irrespective of the form of the cleaning apparatus. It is preferred, however, that as described above the fixing portion is provided in the vicinity of the portion connecting the head portion and the handle, i.e., the rear end portion of the head portion or the front end portion of the handle. It is still preferred that the fixing portion is provided on the upper and lower surface portions of the head portion or handle.

The form of the fixture portion is not particularly limited as long as the area in the vicinity of the opening portion of the cleaning cloth can reliably be secured thereto. For example, there can be listed a fixture portion provided with a plurality of flexible elements forming radial slits called a chrysanthemum-shaped fixture, a fixture portion provided with a mechanical hook, or a fixture portion provided with an engagement recess and a clamping plate provided with an engagement projection corresponding to the engagement recess through a hinge.

The handle and the head portion may be unremovably secured, or detachably attached. The head portion is preferably turnable upside down in the state that the head portion is attached to the handle. Especially, in case the handle comprises the handle body and the attachment members as previously mentioned, it is preferred that the head portion is rotatable about a horizontal axis and engageable at a predetermined angle, and the head portion is turnable upside down with respect to the handle body in that state that the head portion is attached to the handle. It may be designed such that the handle body employs a known articulated mechanism which can be locked at a predetermined angle, the height-wise location of the head portion can be moved upwardly and downwardly with respect to the grip portion, and the grip portion can be reversed with respect to the height-wise location of the head portion. This arrangement, in which the head portion can be reversed in the state that the head portion is attached to the handle, makes it easy to switch the used surface to the non-used surface of the cleaning cloth. As a consequence, the cleaning cloth can be used with no waste.

In the cleaning apparatus of the present invention, its center of gravity is preferably placed at the location of the head portion in the state that the head portion is attached to the handle. By placing the center of gravity of the cleaning apparatus at the location of the head portion as mentioned, such an unstable state can be prevented from occurring that a rear end portion of the handle is attached to a placing surface and the end portion of the head portion is lifted upwardly, when the cleaning apparatus is placed on the placing surface. Accordingly, the grip portion is easy to grip in the state that the cleaning apparatus is placed on the placing surface, and therefore, a cleaning operation can be performed immediately. The method for placing the center of gravity of the cleaning apparatus on the location of the head portion is not particularly limited. For example, there can be listed such methods in which the handle has a hollow interior and the head portion itself is designed high in density so that its weight is increased. Especially, the hollow structure of the handle offers such advantages in that the handle can be maintained its thickness easy to grip without making the handle thinner, and the cleaning apparatus as a whole can be decreased in weight.

In the cleaning apparatus of the present invention, it is preferred that the grip portion of the handle body is higher than the portion for the attachment of the head portion in view of achieving an easy cleaning operation. The handle body may have a barlike configuration.

The head portion may be unremovably secured to or detachably attached to the handle body. In case the grip portion of the handle body is higher than the portion for the attachment of the head portion as mentioned, it is effective in view of performing a cleaning operation by the cleaning cloth with no waste that the handle body and the head portion are detachably attached and turnable upside down. The core member is usually secured undetachably within the head.

In the cleaning apparatus of the present invention, the arrangement for making the handle body expansible and contractible using a known expansible/contractible mechanism is effective for the purposes of cleaning an area at a high location or an area located at an inner part. In case the grip portion of the handle body is higher than the head portion as mentioned, it is preferred that the grip portion is expansible and contractible, and engageable at a predetermined location, and that the attachment portion of the head portion is expansible and contractible, and engageable at a predetermined location. In case the handle body is designed to have the bar-like configuration, it is preferred that the handle body chiefly comprises at least two sleeve-like members, and those members are expansible and contractible, and engageable at a predetermined location. It goes without saying that the handle body may comprise an inexpansible and incontractible member. In case the handle body has a bar-like configuration, its sectional configuration may be elliptical, circular, polygonal or the like, or a combination of them. The handle body is preferably made of vinyl chloride, polypropylene, ABS, poly-carbonate, aluminum or its alloy, wood, or bamboo in view of light-weight, strength and low-cost.

As a method for preventing the cleaning cloth from peeling off during a cleaning operation of the cleaning apparatus of the present invention, there can be employed a method in which a mechanical hook is attached to the handle body and after the head portion is inserted into the insertion space of the cleaning cloth, the cleaning cloth, which is attached to the mechanical hook, is pressed against it for fixture, a method in which a plurality of flexible elements for forming radial slits called a chrysanthemum-shaped metal fixture are provided on the surfaces of the head portion and the handle body and the cleaning cloth is fixedly forced into slits, a method in which the handle body is provided with a recess and a clamping plate provided with an engagement projection corresponding to the engagement recess through a hinge, so that after the cleaning cloth is attached, the engagement projection is brought into engagement with the engagement recess to thereby clamp the cleaning cloth.

The cleaning portion according to the present invention may have a planar cleaning portion composed of a fibrous material and a strip-like or pile-like dusting portion composed of a fibrous material. The form of the cleaning portion is not limited to the bag-like configuration, and the cleaning portion may take on various forms as shown in the embodiments as described later. Further, no limitation is imposed on the form of the dusting portion. It is preferred that the dusting portion is provided at the peripheral edge portion of the cleaning portion or on the back surface of the cleaning portion as shown in the embodiments as described later.

The "dusting portion" exhibits a function of capturing trash, dust, and the like in a cleaning operation.

The fibrous material composing the cleaning cloth of the present invention includes, as a matter of course, a sheet-like fibrous material such as a woven fabric, a non-woven fabric, a thin paper or the like, and also includes a wire-like fibrous material such as a pile or the like usable for the dusting portion.

In case a non-woven fabric is used as the fibrous material, it is particularly preferred that the non-woven fabric is composed of a fibrous material having excellent dust absorbing properties and anti-wear properties. As a non-woven fabric having such favorable properties, there can be listed, for example, a spun lace non-woven fabric or the like.

In case the cleaning cloth is formed by heat sealing the non-woven fabric, it is preferred that a non-woven fabric made of a PET fiber is used, for example, on the cleaning surface side and a non-woven fabric made of a PET/PE (core/sheath) composite fiber is used on the bonding surface side. These non-woven fabrics are preferably obtained by subjecting a PP fiber to water needling through a PP net having a lattice shape arrangement. In that case, it is preferred especially for the PET/PE (core/sheath) composite fiber, which composes the non-woven fabric used on the bonding surface side, to include 10 to 90 wt % of PE.

Further, the non-woven fabric is preferably used as a constituting material for a cleaning cloth in other forms than a bag-like form.

The cleaning portion in the cleaning cloth of the present invention may be formed by placing, for example, two sheet-like fibrous materials one upon the other and then sewing or heat sealing them to form the peripheral surface portion of the bag portion having therein an insertion portion (see FIGS. 28*a* through 28*d* and FIG. 31), or bending a single sheet-like fibrous material to form the peripheral surface portion of the bag portion having therein the insertion portion corresponding to the form of the head (see FIGS. 29 and 30).

Figure 29A:
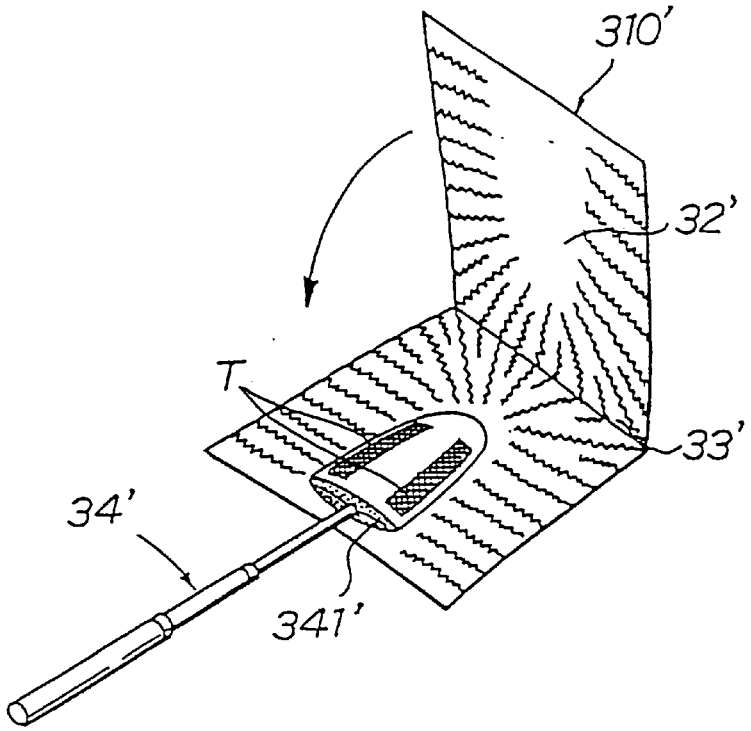
FIG. 29*a* and FIG. 29*b* are views showing a tenth embodiment of a cleaning apparatus.

In case the cleaning cloth of the present invention is composed only of the sheet-like fibrous material, the cleaning portion in the cleaning cloth of the present invention may be formed by cutting the fibrous material 310 (310') into a strap pattern from the peripheral edge portion up to the area in the vicinity of the cleaning portion 32 (or 32') as in the case with the cleaning portion 33 (or 33') in the cleaning cloth according to the embodiment shown in FIGS. 28*a* through 28*d* or FIGS. 29*a* and 29*b*, or by tearing the fibrous material into a strap-like configuration along a cut-line formed on perforation scores preliminarily formed when in use. The cut-out (or cut line) may be linear, zigzag, wavy or the like. As shown in FIG. 29*a*, in case a single sheet-like fibrous material 310' is folded half to form the cleaning cloth 31', the folding line is formed by perforation scores and the fibrous material is folded to be secured to the head 341' and thereafter, the fibrous material 310' is cut along the perforation scores to form the cleaning portions 33' at areas located on both sides of the folding line.

In case the cleaning cloth of the present invention is made of a sheet-like fibrous material or wire-like fibrous material, the cleaning cloth of the present invention is preferably formed as such that, as in the case with the embodiment shown in FIGS. 30*a* and 30*b* or FIGS. 31*a* through 31*d*, the wire-like fibrous material composing the dusting portion 33' is jointed to the sheet-like fibrous material 310' composing the cleaning portion 32' by sewing or heat sealing, so that the dusting portion 33' is arranged on the peripheral edge portion (see FIG. 30*b*) or on the back side (see FIG. 31) of the cleaning portion 32'.

The handle according to the present invention may comprise a handle body 340, and a head 341 attached to an end portion of the handle body 340 as in the handle 34 of the cleaning apparatus shown in FIG. 13, for example.

It is preferred that the handle body chiefly comprises at least two sleeve-like members and those component parts are made expansible and contractible using a known expansible/contractible mechanism, as in the case with the handle body 340 of the embodiment shown in FIG. 13, for example. The handle body may be formed of an inexpansible and incontractible member formed of a single bar-like member. The sectional configuration of the handle body may be elliptical, circular, or polygonal, or a combination of them. The sleeve-like member or the bar-like member constituting the handle body is preferably made of vinyl chloride, aluminum or its alloy.

As the flexible resilient material for composing the head portion in the handle of the cleaning apparatus of the present invention, it is preferred to use a sponge-like porous resilient material, a cushion-like resilient material obtained by putting a fibrous material such as felt, cotton or the like into a bag made of an artificial leather or a fabric, or a resilient member such as rubber.

In case the head is formed of the sponge-like porous resilient member, it is particularly preferred to use a porous resilient member composed of a soft foamed synthetic resin having excellent durability. As a porous resilient member having such properties, there can be listed, for example, foamed polyethylene, foamed urethane, or the like.

In case the head portion is formed of a porous resilient member made synthetic resin of the type as mentioned above, it is preferred, in order to enhance a smooth attachment and detachment of the cleaning cloth, to improve the surface lubricant. As a method for improving the surface lubricant, there can be listed, for example, a meltome treatment (treatment for improving the surface lubricant).

The form of the head can appropriately be changed depending on what cleaning cloth is to be attached. For example, it may take a form, as in the case with the head 341 (or 341') of the embodiment shown in FIG. 32, having a generally U-shaped configuration and whose end portion is gradually reduced (see FIG. 32*a*), or a rectangular form (see FIG. 32*b*). By designing the head to have such a configuration as mentioned above, an angular portion, a narrow space or the like can more easily be cleaned. As for the thickness of the head, it may be arranged to have a predetermined thickness, or it may be tapered such that the thickness is reduced towards the end portion as in the case with the head portion 341 of the embodiment shown in FIG. 13, for example. It may also be tapered such that the thickness is reduced in the width direction as in the case with the head 341 of the embodiment shown in FIG. 13. Especially, the tapered arrangement as in the head 341 is effective in view of easy cleaning of the angular portion or narrow space.

Figure 32A:
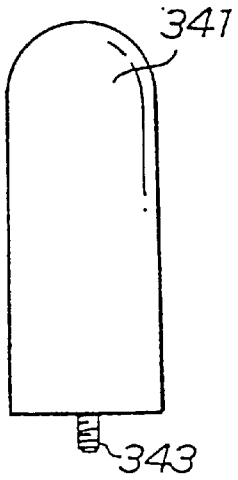
FIG. 32*a* and FIG. 32*b* are views showing other embodiments of a head of a cleaning apparatus according to the present invention.
Figure 32B:
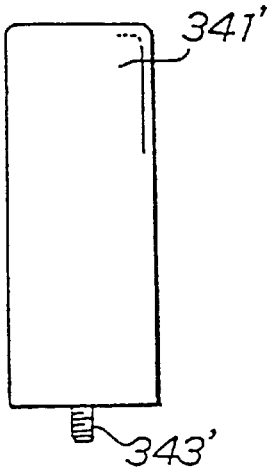
Figure 33A:
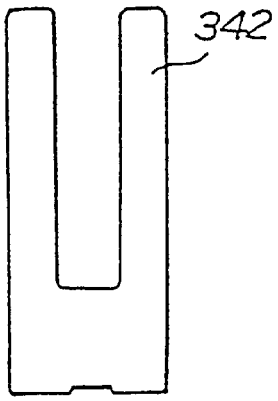
FIG. 33*a*, FIG. 33*b* and FIG. 33*c* are views showing various embodiments of a core member provided in the interior of a head of a cleaning apparatus according to the present invention.
Figure 33B:
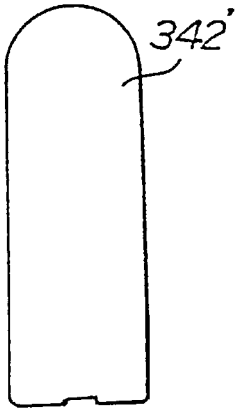
Figure 33C:
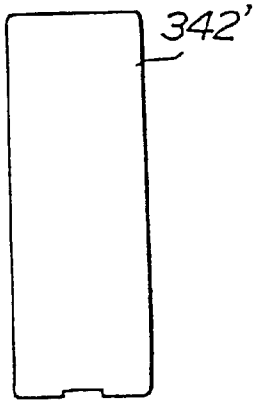

It is preferred that a core member is arranged within the head in the handle of the cleaning apparatus of the present invention in order to provide a desired rigidity to the head. The core member arrangement within the head is particularly effective when the head is formed of the porous resilient member or the cushion-like member. The mode for carrying out the core member can appropriately be changed depending on what form the head takes. For example, the core member 342 (or 342') of the embodiment as shown in FIGS. 33*a* through 33*c* is preferable. The core member is preferably made of synthetic resin such as polypropylene, ABS, poly-carbonate or the like, or metal such as stainless steel, spring steel or the like. It is preferred that an attachment means (for example, male threaded member 343 (see FIG. 32)) for attaching the head to the handle body is provided on a lower end portion of this core member.

In case the head in the handle of the cleaning apparatus of the present invention is formed of a porous resilient member or a cushion-like member, it is preferred that a core member is arranged within the head. However, in case the head is formed of a resilient member such as a comparatively hard rubber or the like, the core member may be omitted.

As a fixing means after the cleaning cloth is attached to the head, it may arranged such that the cleaning cloth 31 is provided with a tab 321 so that the tab 321 is fixedly forced into the insertion space of the head 341 as in the embodiment shown in FIG. 28, or a mechanical hook (for example, "MAGIC TAPE" of a) T is adhered to the surface of the head 341' so that the cleaning cloth 31' is fixed by the tape as in the embodiment shown in FIGS. 29 and 30.

In the handle of the cleaning apparatus of the present invention, the handle body and the head portion are preferably attachable and detachable. However, they may be of the fixed type in which they cannot be attached nor detached. In case the handle body and the head portion are attachable and detachable, a known attachment means such as a threading attachment, engagement, fitting or the like may be employed. It is preferred to employ the threading attachment as in the embodiment of FIGS. 13 and 14.

The embodiment of the cleaning apparatus of the present invention may comprise the cleaning cloth 31 (or 31') and the handle 34 (or 34' (see FIGS. 29 and 30)) of the cleaning apparatus according to the above-mentioned embodiment. It may be made by inserting and then fixing the head portion of the handle of the cleaning apparatus into the insertion space, or by bending the cleaning cloth in such a manner as to enclose the head portion and then fixing thereto (see FIGS. 29 and 30). The cleaning apparatus of the present invention can be used for performing a cleaning operation utilizing the cleaning portion aside from its use as a duster utilizing the dusting portion. Thus, it can be widely used depending on what location is to be cleaned. Especially, in case the cleaning cloth is expansible and contractible, the dirty cleaning cloth after use can easily be replaced by detaching the cleaning cloth from the head and attaching a new cleaning cloth thereto.

The present invention will be described more specifically by way of embodiments.

Figure 2:
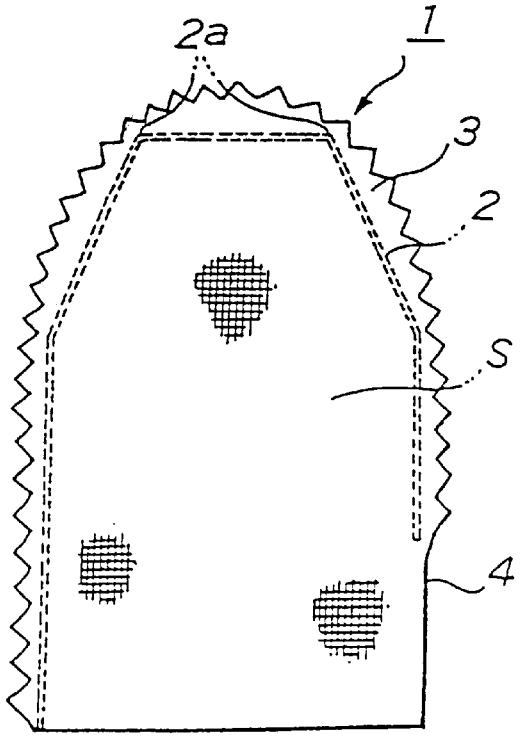
FIG. 2 is a plan view of the cleaning cloth of FIG. 1.

FIGS. 1 and 2 show an embodiment A of a cleaning cloth according to the present invention. In the illustrations, reference numeral 1 denotes a cleaning cloth.

As shown in FIGS. 1 and 2, the cleaning cloth 1 of the embodiment A is produced by bonding two spun lace non-woven fabrics, whose peripheral edge portion is cut into a continuous chevron-like configuration, by heat sealing to form a flat bag shape having therein an insertion space S. The cleaning cloth 1 of this embodiment is provided with a bonded portion 2 of a width of 5 mm having two angular portions 2*a* at an end portion thereof. The cleaning cloth 1 is further provided at an external side of the bonded portion 2 with a non-bonded portion 3 of a width of from 10 mm to 30 mm along the peripheral edge portion of the cleaning cloth 1. A slit 4 is formed in one side portion connected to the opening portion of the cleaning cloth 1 and adapted to enhance an easy attachment and detachment of the cleaning cloth 1.

The spun lace non-woven fabric uses a non-woven fabric (basis weight of 24 g/m$^2$) made of a PET fiber (PET 100%, 1.5 d/51 mm) on the cleaning surface side and uses a non-woven fabric (basis weight of 24/m$^2$) made of a PET (core)/PE (sheath) [(PET/PE) weight ratio=60/40, 2 d/51 mm] composite fiber on the bonding surface side. These non-woven fabrics are obtained by subjecting a PP fiber (PP 100%) to water needling through a PP net (basis weight of 5 g/m$^2$) having a lattice shape arrangement.

The cleaning cloth 1 can perform a suitable cleaning operation depending on what area is to be cleaned. For example, the head portion of the handle body as later described is inserted into the insertion space S and a cleaning operation is performed with the inner side of the bonded portion 2. And the non-bonded portion 3 is inserted into the narrow space to absorb dust in the space so that the dust can be removed therefrom. Moreover, no overlapping width is required as in the conventional sheet type cleaning apparatus and the back side can be used by turning the cleaning cloth inside out. Accordingly, the entire area of the cleaning cloth can fully be used without leaving any non-used portion, and therefore, this is economically efficient.

FIGS. 3 through 7 show a first embodiment of a cleaning apparatus according to the present invention. In these illustrations, reference numeral 11 denotes a cleaning apparatus.

Figure 3:
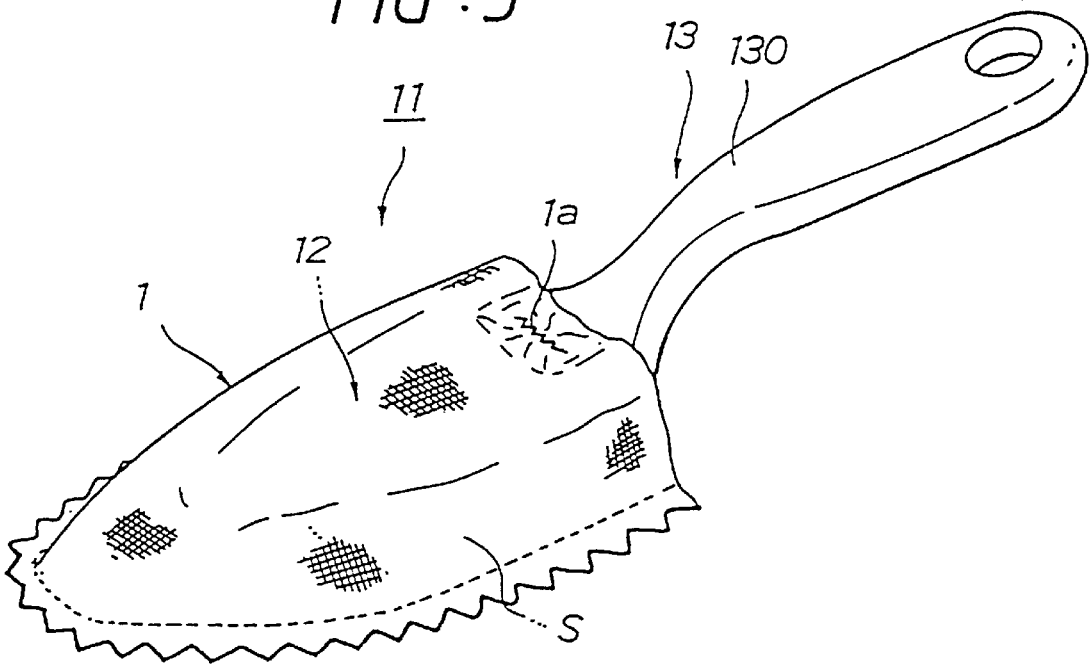
FIG. 3 is a perspective view showing a first embodiment of a cleaning apparatus according to the present invention.
Figure 4:
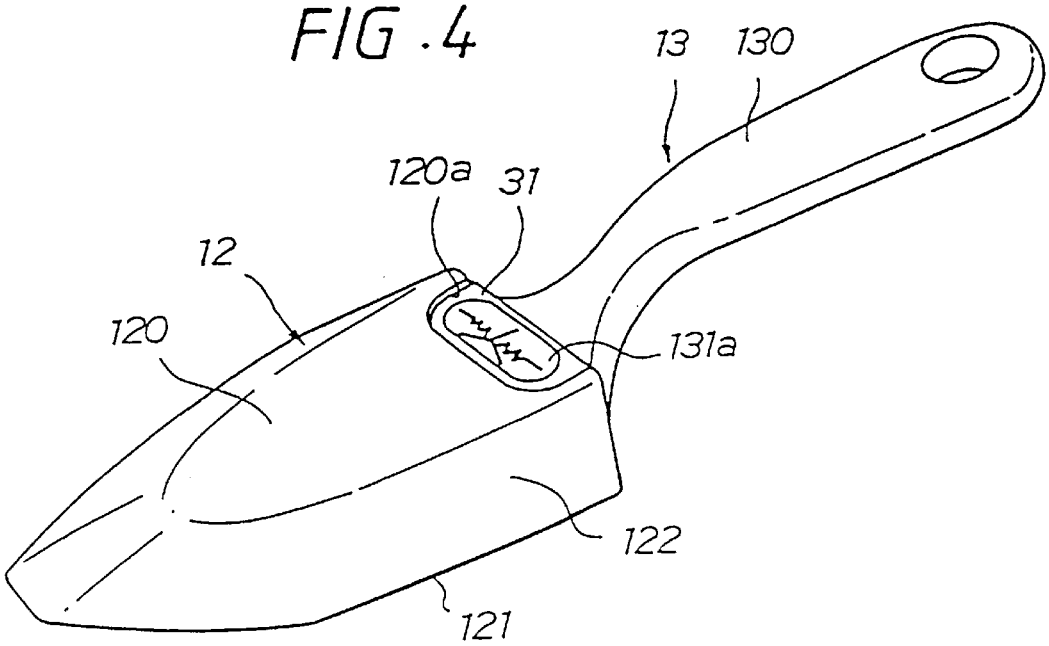
FIG. 4 is a perspective view showing the cleaning apparatus of FIG. 3, in which a cleaning cloth is already removed therefrom.
Figure 5:
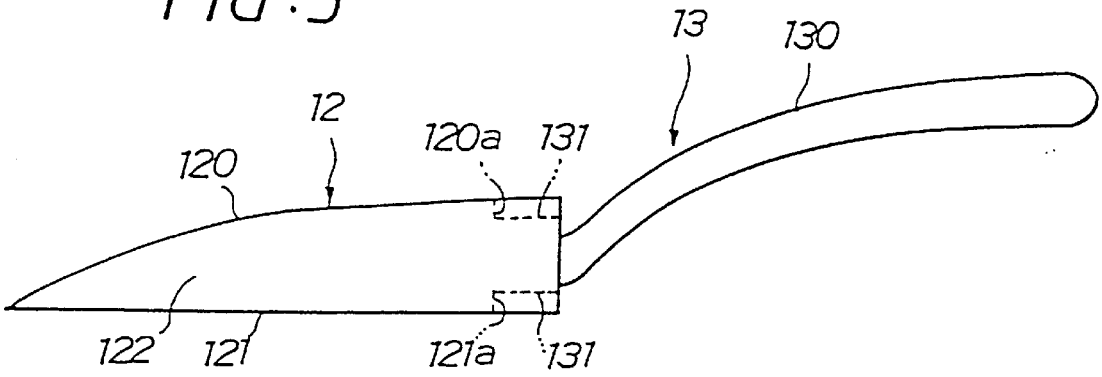
FIG. 5 is a side view showing the cleaning apparatus of FIG. 3, in which a cleaning cloth is already removed therefrom.
Figure 6A:
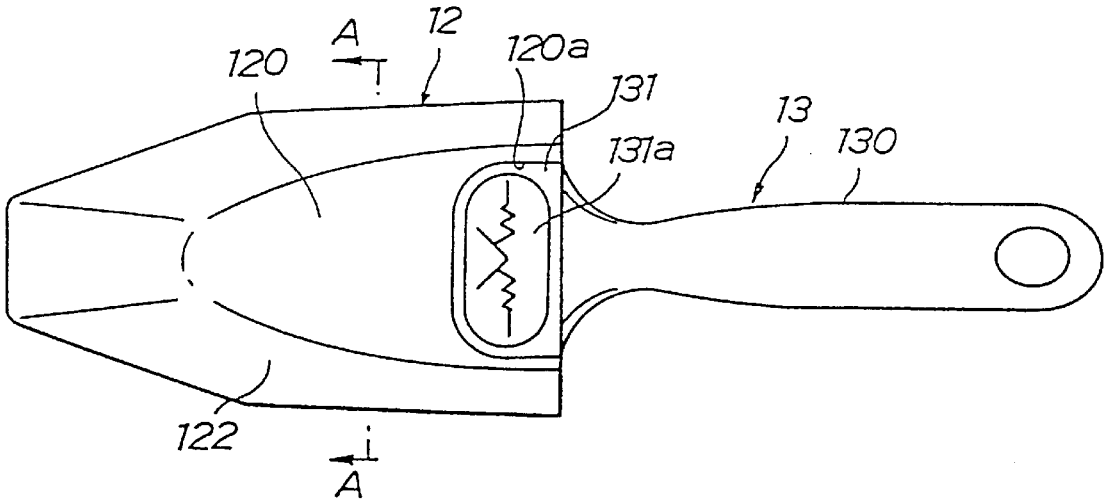
FIG. 6*a* and FIG. 6*b* are views showing the cleaning apparatus of FIG. 3 but a cleaning cloth is already removed therefrom.
Figure 6B:
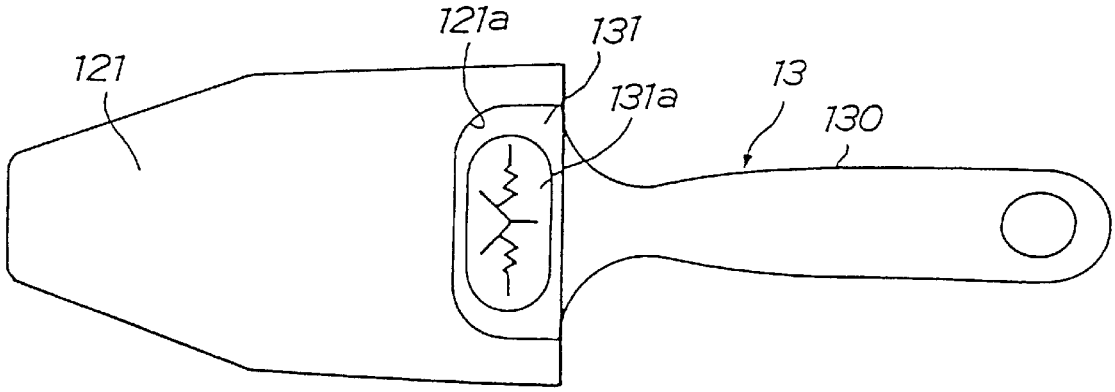

As shown in FIG. 3, the cleaning apparatus 11 according to this embodiment comprises a handle 13 including a head portion 12 made of a flexible material and disposed at an end portion thereof, and the flat bag-like cleaning cloth 1 having therein an insertion space S. The cleaning cloth 1 is attached to the head portion 12 through the insertion space S.

Figure 23A:
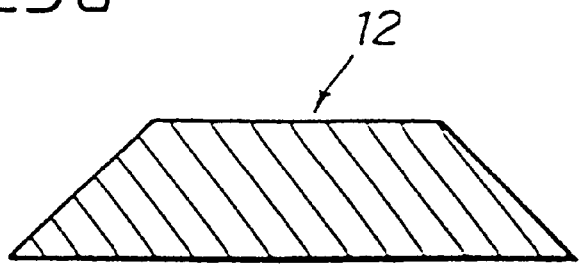
FIG. 23*a* is another sectional view taken on line A—A of FIG. 6*a*.

The head portion 12 comprises a porous flexible material (C-hardness=20 to 35) made of soft ester series urethane foam and whose surface is subjected to meltome treatment. The head portion 12 has such a configuration in a plan view that two angular portions are formed at the end portion and it gradually exhibits a wide hexagonal configuration towards its rear side (see FIG. 6*a*). The head portion 12 is designed such that its thickness is reduced towards the end portion and in the width direction. The sectional configuration of the head portion 12 is trapezoidal (see FIG. 23*a*). At the end portion of the head portion 12, the upper surface portion 120 and the lower surface portion 12 make an acute angle. An angle of the angular portion formed between a lower surface portion 121 and a side surface portion 122 continuous with the lower surface portion 121 is the right angle or an angle more acute than that.

In the cleaning apparatus according to this embodiment, as shown in FIGS. 4 through 7, the head portion 12 is provided at rear parts of an upper surface portion 120 and a lower surface portion 121 thereof with cut-out portions 120*a* and 121*a* for exposing a clipper 131*a* as later described. A recess 123 (see FIG. 7) is formed in a rear end portion of the head portion 12. An attachment member 131 of the handle 13 as later described can be fixedly fitted into this recess 123.

The handle 13 comprises a handle body 130 including a grip portion, and an attachment member 131 attached to an end portion thereof. The handle body 130 is curved such that the grip portion is higher than the head portion 12 when the head portion 12 is attached to the attachment member 131. The handle body 130 is of a hollow structure, and the center of gravity of the cleaning apparatus 11 is placed at the location of the head portion 12.

Figure 7:
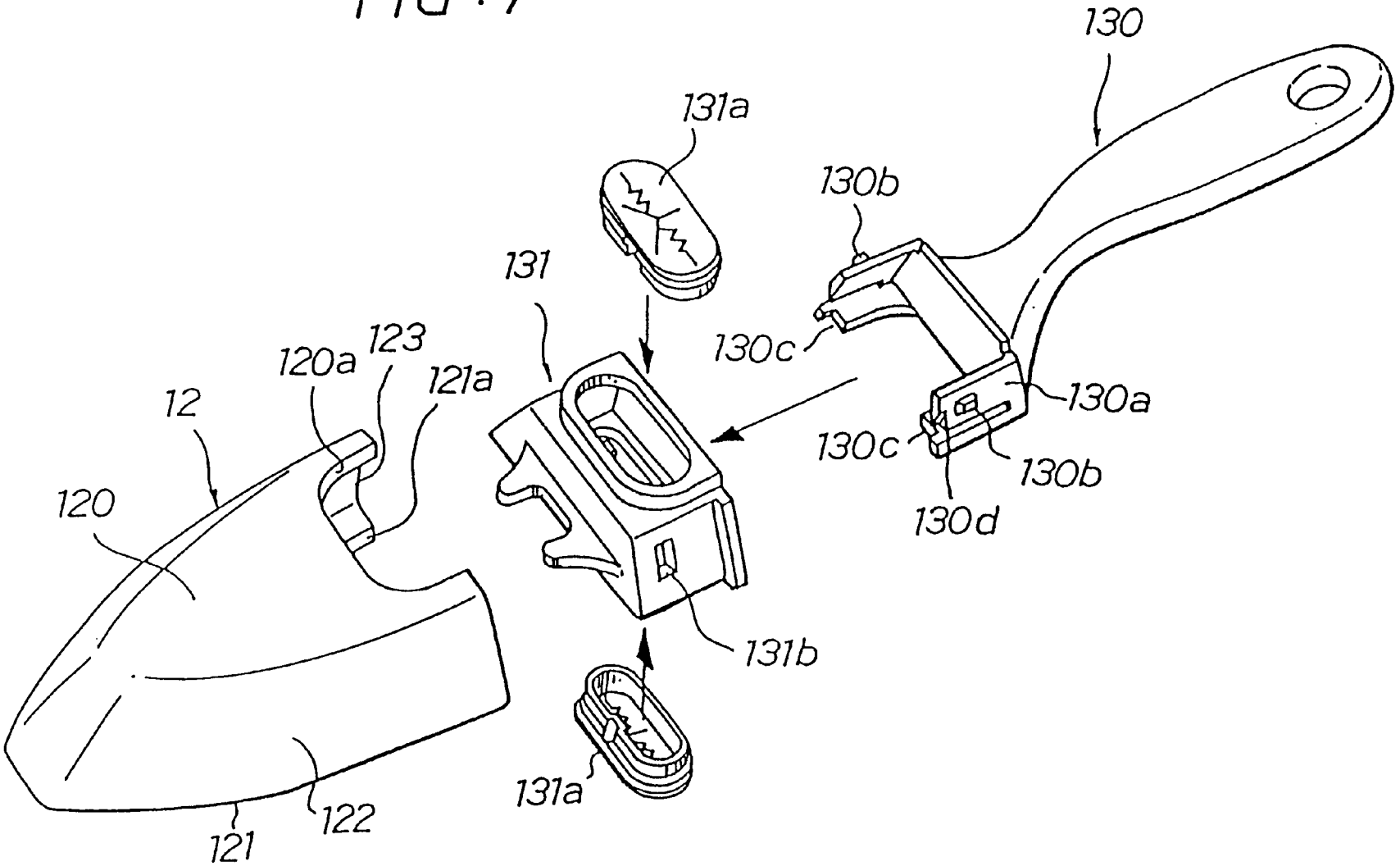
FIG. 7 is a perspective view of the cleaning apparatus of FIG. 6, showing a handle and a head portion in an exploded state.

As shown in FIG. 7, the attachment member 131 has at its distal end portion thereof two protrusions which secure easy and reliable attachment of the attachment member 131 to the head portion 12.

Also, as shown in FIG. 7, an element 130*a* having a generally horizontal U-shape in a plan view is formed at the end portion of the handle body 130. A projection 130*b* is formed on each side portion of the element 130*a*. The attachment member 131 has a hollow interior so that the element 130*a* can be inserted therein first with the rear part. An engagement hole 131*b* is formed in each side surface of the attachment member 131, so that the projection 130*b* can engage therein.

At the lower part of the end of the element 130*a* are formed cut-off portions 130*c*, 130*c*, and a taper portion 130*d* as shown in FIG. 7 which secures smooth and reliable attachment of the attachment member 131 to the end of the handle body 130.

The clippers 131*a* are fitted respectively to upper and lower surface portions of the attachment member 131. Each clipper 131*a* is provided with a plurality of flexible elements forming slits called a chrysanthemum-shaped fixture. The cleaning cloth 1 can easily and reliably secured to the attachment member 131 merely by pushing the area in the vicinity 1*a* of the opening portion of the cleaning cloth 1 into the slits. Each clipper 131*a* is arranged on the attachment member 131 such that when the head portion 12 is attached to the attachment member 131, the clipper 131*a* is depressed downwardly from the surface of the head portion 12. When the area in the vicinity 1*a* of the opening portion of the cleaning cloth 1 is secured to the clipper 131*a*, the surface of the area in the vicinity 1*a* of the opening portion is depressed from the surface of the cleaning cloth 1 covering the surface of the head portion 12 (see FIG. 3).

When the cleaning cloth 11 of the present embodiment is used, first, as shown by the arrows in FIG. 7, the handle body 130, the attachment member 131 and the clippers 131*a* are assembled to form the handle 13. Then, the head portion 12 is fixedly bonded to the attachment member 131 to create the state of FIG. 4. Thereafter, the cleaning cloth 1 is attached to the head portion 12 in such a manner as to cover the head portion 12. Since meltome treatment is applied to the surface of the head portion 12 to enhance smoothness of the surface, the cleaning cloth 1 can be attached smoothly to the head portion 12. Then, the area in the vicinity 1*a* of the opening portion is pushed into the clipper 131*a*, so that the cleaning cloth 1 is firmly secured to the head portion 12. In addition, the cleaning apparatus 11 of the first embodiment is sold in the market in such a state that an assembly body in which the head portion 12, attachment member 131 and the clipper 131*a* are assembled into a unitary body and the handle body 130 are packed in a box. Thereby, a user obtains a cleaning apparatus which can be used only by joining the assembly body and the handle body 130 together.

According to the cleaning apparatus of the present invention, in the cleaning of tables, desks or the like which have comparatively large areas, the area located inside of the bonded portion of the cleaning cloth is mainly used to wipe out dust. In the cleaning of narrow spaces or the like, such as gaps formed between adjacent keys of a keyboard, the non-bonded portion 3 is inserted therein to adsorb dust or the like so as to clean the narrow spaces.

When the surface of the cleaning cloth 1 gets very dirty, first, the area in the vicinity 1*a* of the opening portion of the cleaning cloth 1 is peeled off the clippers 131, and then, the cleaning cloth 1 is removed from the head portion 12 by picking up the area in the vicinity 1*a* of the opening portion. Then, the detached cleaning cloth 1 is turned inside out and attached again to the head portion 12. By doing this, both the upper and lower surfaces of the cleaning cloth 1 can fully be used with no waste. Since dust, etc. are hardly adhered to the area in the vicinity 1*a* of the opening portion of the cleaning cloth 1*a*, there is no fear that the clippers 131*a* will be choked with the dust, etc. when the cleaning cloth 1 is turned inside out and secured again.

According to the cleaning apparatus 11 of the first embodiment, the end of the head portion 12, which is readily deformed in accordance with the configuration of an object to be cleaned, is hardly susceptible to fatigue and therefore, it does not become difficult to completely remove dirty things such as dusts, etc., firmly stuck. Moreover, since the head portion has an appropriate hardness and flexibility, a favorable contact with the object to be cleaned is obtained and the object can fully be cleaned. In addition, there is no fear that the object will be damaged and the cleaning cloth will be torn during a cleaning operation.

The head portion 12 has a lower surface portion 121 and a side surface portion 122, and the angle of the angular portion formed between the two surface portions 121 and 122 is 90 degrees or smaller. Accordingly, the cleaning cloth 1 can be brought into intimate contact with the corner portion, the angular portion or the like where dust, etc. tend to stack up by pressing the angular portion against them. As a consequence, those places can also be reliably cleaned.

Furthermore, in the cleaning apparatus 11 of this embodiment, its center of gravity is placed at the location of the head portion 12. Accordingly, such an unstable state can be prevented from occurring that a rear end portion of the handle 13 is attached to the placing surface and the end portion of the head portion 12 is lifted upwardly. Accordingly, the grip portion is easy to grip in the state that the cleaning apparatus is placed on the placing surface, and therefore, a cleaning operation can be performed immediately. Moreover, since the handle 13 is of a hollow structure and its center of gravity is placed at the location of the head portion 12, the handle 13 can be maintained in the size easy to grasp without a need of reducing the thickness of the handle 13.

When the cleaning cloth 1 is secured to the clippers 131*a*, the surface of the area in the vicinity 1*a* of the opening portion of the cleaning cloth 1 is depressed downwardly from the surface of the cleaning cloth 1 covering the upper and lower surface portions 120, 121 of the head portion 12. Accordingly, the user can replace the cleaning cloth without picking up the dirty area. Since the insertion space S of the cleaning cloth 1 is located in such a manner as to correspond to the head portion 12, the entire surface of the cleaning cloth 1 excepting the area in the vicinity 1*a* of the opening portion can fully be used and therefore, this is economically efficient.

FIGS. 8 through 11 show second embodiment of a cleaning apparatus according to the present invention. In those illustrations, reference numeral 210 denotes a cleaning apparatus.

Figure 8:
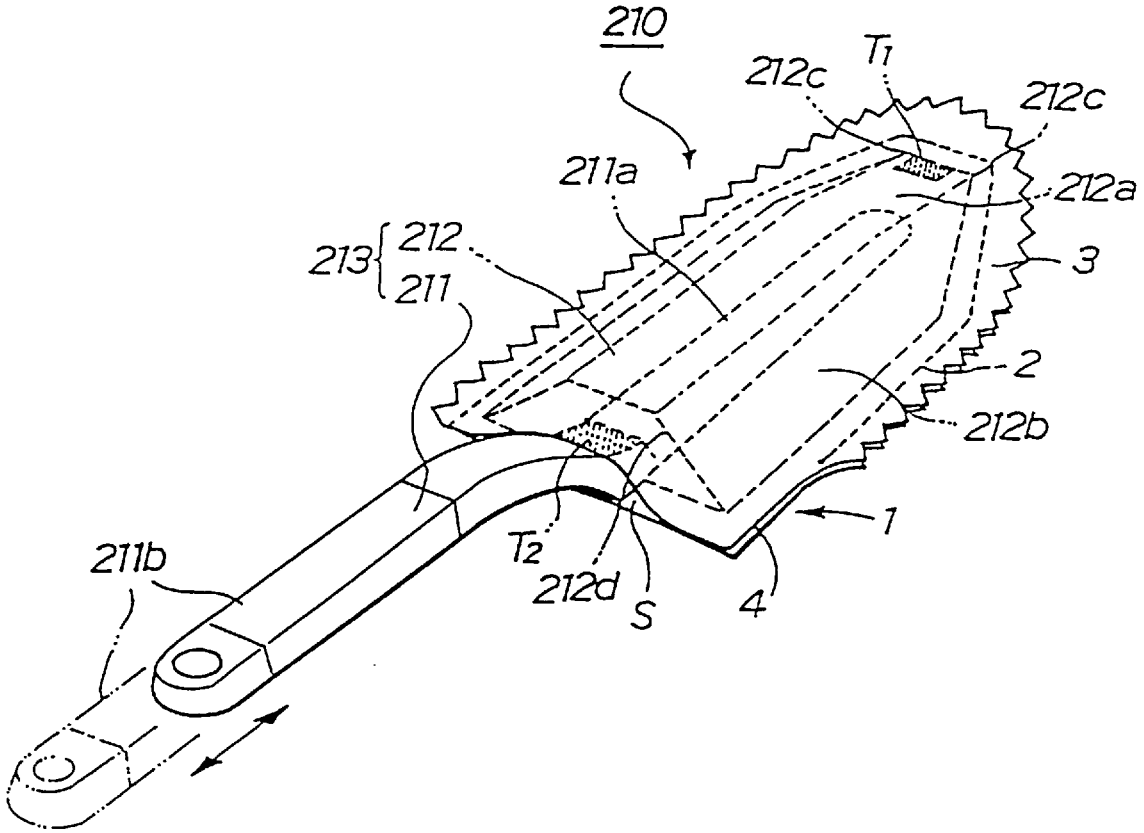
FIG. 8 is a perspective view showing a second embodiment of a cleaning apparatus according to the present invention.

As shown in FIG. 8, the cleaning apparatus 210 of the second embodiment comprises a handle 213 whose head portion 212 made of a flexible material and for the attachment of a cleaning cloth is secured to an end portion of a handle body 211, and the cleaning cloth 1 of the above-mentioned embodiment A. The head portion 212 is inserted into the insertion space S of the cleaning cloth 1, and the cleaning cloth 1 is attached to the handle 213.

The head portion 212 comprises a porous flexible material made of poly-urethane and whose surface is subjected to meltome treatment. The head portion 212 is tapered 212*a*, 212*b* such that the thickness is gradually reduced towards the end portion and in the width direction. Two angular portions 212*c* are provided on the end portion of the head portion 212. A mechanical hook T1 is adhered to a forward portion of the head portion 212. The mechanical hook T1 catches the inner surface of the cleaning cloth 1 when the cleaning cloth is detached. The cleaning cloth 1 can easily be turned inside out simultaneously when the cleaning cloth 1 is detached from the head portion 212. The head portion 212 is provided therein with an insertion portion 212*d* for inserting therein a core member as later described.

The handle body 211 is a molded member made of polypropylene. A core member 211*a* to be inserted into the insertion portion 212*d* of the head portion 212 is integral with an end portion of the handle body 211. The handle body 211 is designed such that the grip 211*b* portion is higher than the core member 211*a* portion at the end portion. This arrangement enhances an easy cleaning operation. A mechanical hook T2 is adhered to an area located between the core member 211*a* portion and the grip 211*b* portion in the handle body 211. By pressing the cleaning cloth 1 against this mechanical hook T2, the cleaning cloth 1 attached to the head portion 212 is prevented from peeling off during a cleaning operation. The grip 211*b* comprises an expansible/contractible mechanism which is constructed of a duplex structure including engagement portions engageable with each other at a predetermined location. Owing to this arrangement, the length of the grip 211*b* can be adjusted in accordance with necessity.

Figure 9:
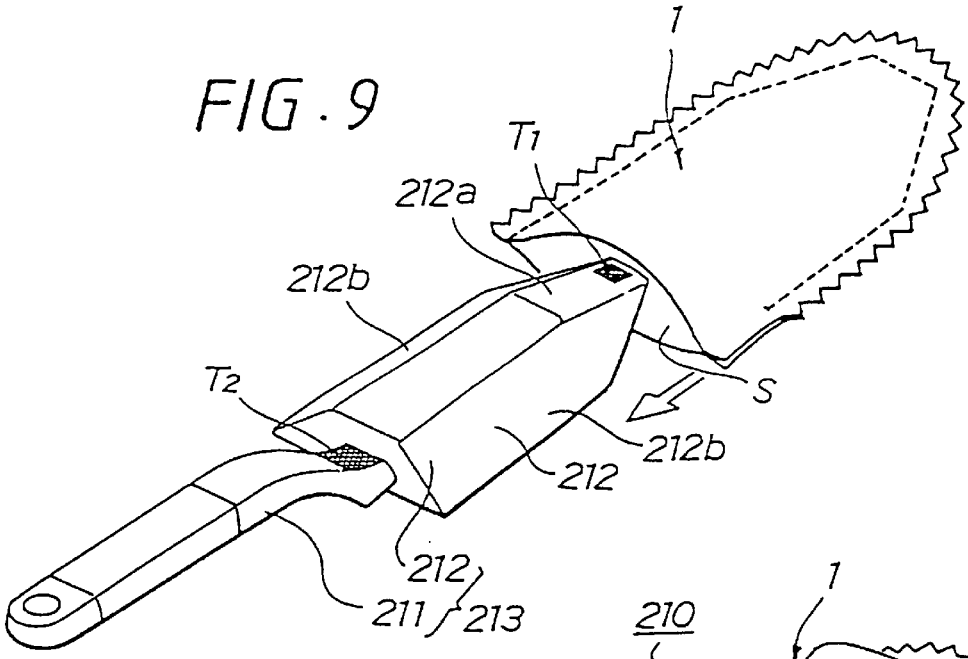
FIG. 9 is a perspective view showing the cleaning apparatus of FIG. 8, with a cleaning cloth being attached to a head portion thereof.

When the cleaning apparatus 210 of the second embodiment is used, first, as shown in FIG. 9, the cleaning cloth 1 attached to the head portion 212 of the handle 213 in such a manner as to cover the head portion 212. At that time, since the surface of the head portion 212 is subjected to meltome treatment, the cleaning cloth 1 can smoothly be attached. Then, the cleaning cloth 1 is fixedly pressed against the top of the mechanical hook T2 which is adhered to the handle body 211, thereby assembling the cleaning apparatus.

Dust, etc. stacked on a table or the like which have a comparatively large area are wiped out chiefly using the area located at the internal side of the bonded portion 2 of the cleaning cloth 1. On the other hand, dust, etc. in the narrow space between adjacent keys on the keyboard are cleaned by inserting the non-bonded portion 3 therein and absorbing the dust, etc. therefrom.

Figure 10:
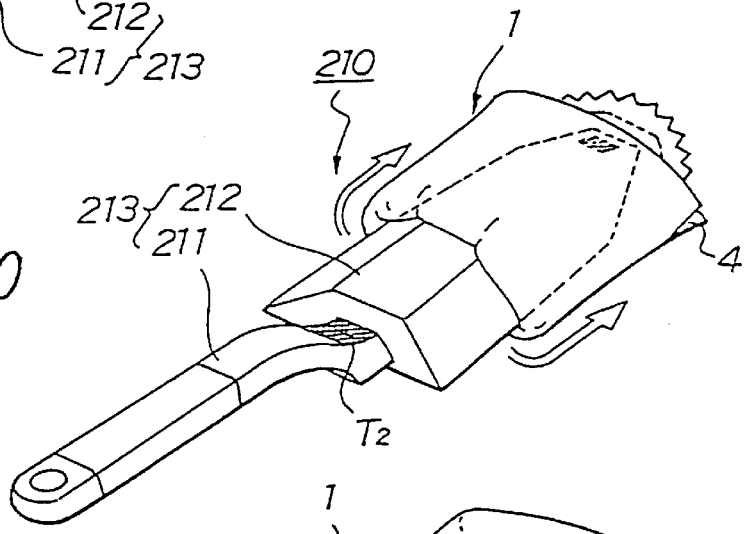
FIG. 10 is a perspective view showing the cleaning apparatus of FIG. 8, with a cleaning cloth being partially removed from a head portion thereof.
Figure 11:
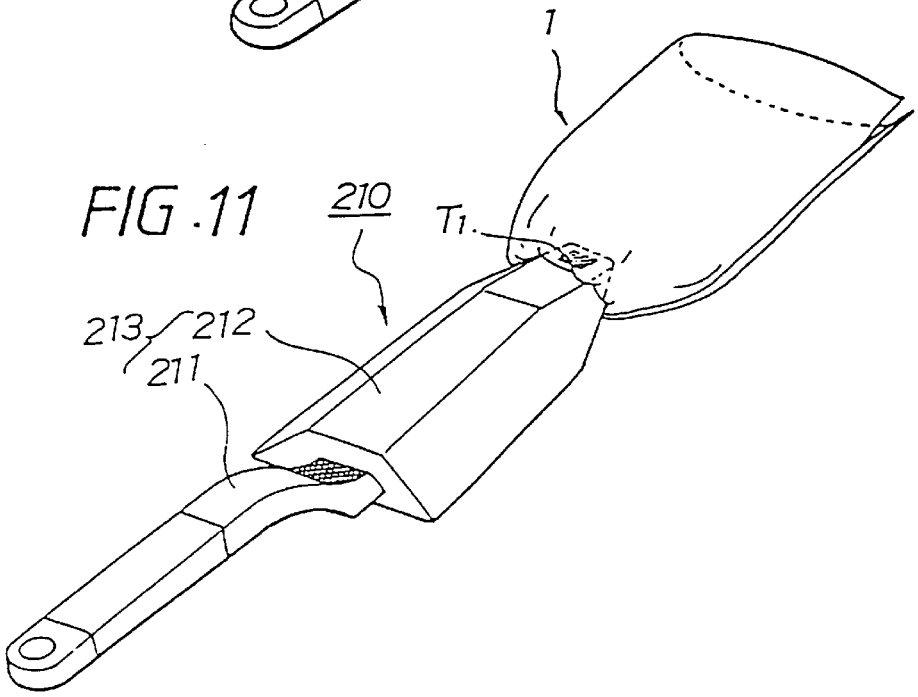
FIG. 11 is a perspective view showing the cleaning apparatus of FIG. 8, in which the cleaning cloth is turned inside out so as to be ready for removal from the head portion.

When the surface of the cleaning cloth 1 gets very dirty, first, the cleaning cloth 1 is peeled off the mechanical hook T2 of the handle body 211. Then, as shown in FIG. 10, the cleaning cloth 1 is detached from the head portion 212 by picking up that side of the cleaning cloth 1 where no slits are provided. When the cleaning cloth 1 is peeled off by picking up that side of the cleaning cloth 1 where no slits are provided as mentioned, the non-woven fabric can extremely easily be detached because the end portion of the slit 4 serves as a fulcrum. At that time, since the inner surface of the cleaning cloth 1 is caught by the mechanical hook T1 which is adhered to the forward portion of the head portion 212, the cleaning cloth 1 is turned inside out when the cleaning cloth 1 is detached from the head portion 212 as shown in FIG. 11. Accordingly, the cleaning cloth 1 can be turned inside out hardly touching the upper surface side where the cleaning cloth 1 is very dirty. Furthermore, by attaching the cleaning cloth 1, which is turned inside out, again to the head portion 212, both sides of the cleaning cloth 1 can fully be used with no waste.

In this way, the cleaning apparatus 210 of the second embodiment is capable of, as a matter of course, cleaning (or sweeping) the top of the desk, the table or the like, and also capable of cleaning a narrow space in a satisfactory manner. Furthermore, the cleaning cloth 1 can easily be attached and detached without making the hand dirty, and this cleaning apparatus 210 is very handy to use.

Since the cleaning cloth 1 is of a replaceable type and can easily be replaced when it gets dirty, the cleaning cloth 1 can always be used in a sanitary condition.

In the first and second embodiments of the cleaning apparatus of the present invention, as particularly preferred forms of the cleaning apparatus to which a cleaning cloth is not attached, the following cleaning apparatus can be mentioned. The appearance of the following cleaning apparatus is the same as those of the first and second embodiments.

According to cleaning cloths of the first and second embodiments as mentioned below, the head portion has an angular portion and preferable flexibility so that a narrow space can be effectively cleaned.

A cleaning apparatus has a head portion to which a cleaning cloth is attached, the head portion being provided at a front end portion of a handle.

The head portion has an elongated shape and a flat configuration in which the thickness thereof is smaller than the width thereof, a forward portion of the head portion being configurated such that at least the upper surface thereof forms a tilt surface inclined toward the front end portion of said head portion, and the tilt surface and the bottom surface thereof making an acute angle at the forward to portion.

The head portion is connected at the backward portion thereof to the front end portion of the handle such that the forward portion of the head portion is aligned with the longitudinal direction of the to handle.

The handle is configurated such that the handle has a grip portion located above the upper surface of the head portion and A fixing portion for fixing a cleaning cloth to be attached to the head portion is provided with the head portion or in the vicinity of the front end portion of the handle.

A preferred dimension (length) and a preferred angle of each member of the cleaning apparatus is as follows:

a) The longitudinal length of the head portion: 80 to 300 mm, particularly 100 to 200 mm.

b) The thickness of the head portion (average thickness): 10 to 50 mm, particularly 15 to 40 mm.

c) The width of the head portion: 50 to 150 mm and smaller than the longitudinal length, particularly 80 to 120 mm.

d) The length of the tilt surface inclined toward the forward portion of the head portion: 300 mm or less, particularly 40 to 120 mm.

e) The angle formed between the lower surface and the tilt surface of the head portion: 15° to 70°, particularly 20° to 50°.

f) The location of the grip portion: 0 to 90 mm, particularly 0 to 60 mm above the upper surface of the head portion.

g) The length of the grip portion: 80 to 300 mm, particularly 100 to 200 mm.

h) The opposing side surfaces of the head portion each are tilt surfaces, the angle formed between the tilt surface and the bottom surface being less than 90°, particularly 40° to 80°.

In the cleaning apparatus of the first and second embodiments, as the cleaning cloth, the bag-like cleaning cloth was employed. When the cleaning apparatus in the state that a cleaning cloth is not attached portion is preferably a bag-like configuration, but a sheet-like configuration is also available.

[Embodiment B of Cleaning Cloth According to the Present Invention]

Figure 12:
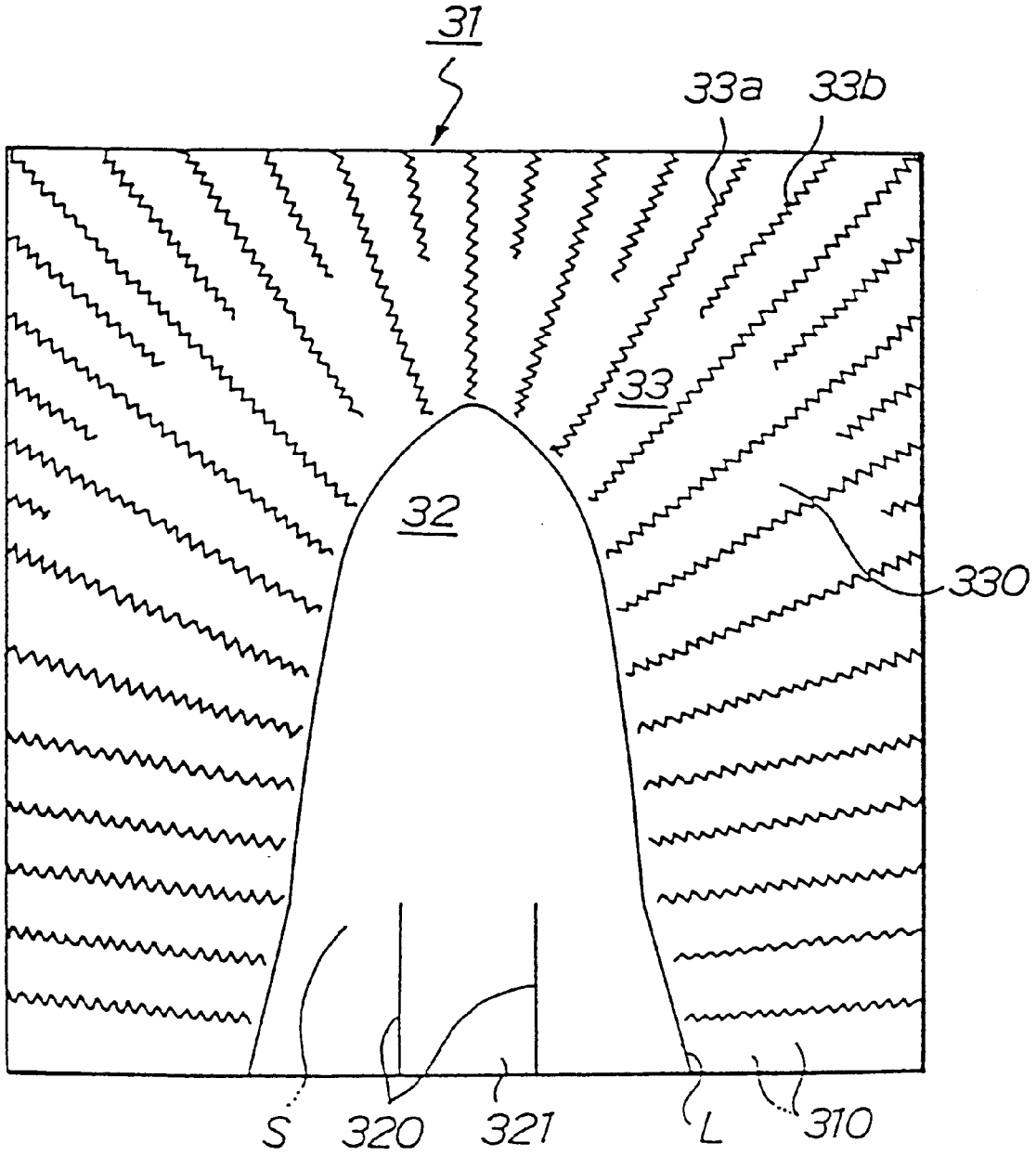
FIG. 12 is a perspective view showing an embodiment B of a cleaning cloth according to the present invention.

FIG. 12 shows the embodiment B of a cleaning cloth according to the present invention. In this illustration, reference numeral 31 denotes a cleaning cloth.

As shown in FIG. 12, the cleaning cloth 31 of embodiment B comprises a dust absorbing non-woven fabric (fibrous material) including a cleaning portion 32 which forms a peripheral surface portion of a bag portion having therein an insertion space S, and a dusting portion 33 having a plurality of strap-like dusting elements 330 provided on its peripheral edge portion.

The cleaning cloth 31 comprises two generally regular square dust absorbing non-woven fabrics 310, 310, in a plan view, which are sewn in a generally inverted U-shape (see the solid line L in the illustration) from lower end portions to central portions thereof. By this sewing, the cleaning portion 32 having therein a flat insertion space S is provided, and the cleaning portion 32 and the dusting portion 33 are defined.

A pair of vertical cuts 320, 320 are formed in a lower end portion of the cleaning portion 32 of the cleaning cloth 31, and a tab 321 to be attached to a head 341 (see FIG. 13) in the handle 34 of the cleaning apparatus as later described is provided therebetween.

The dusting portion 33 consists of a plurality of strap-like dusting elements 330 which are formed by cutting 33*a* the non-woven fabrics 310, 310 in a zigzag pattern from the peripheral edge portions to the areas in the vicinity of the sewn areas. Those dusting elements 330, which are located at an end portion of the dusting portion 33, have cuts 33*b* formed in a half-split fashion in the width direction from the end portions to the lengthwise intermediate portions. This arrangement makes it possible to dust at a limited space.

The cleaning cloth 31 can perform various ways of cleaning operation depending on what location is to be cleaned. For example, by inserting a head 341 (see FIG. 13) of the handle 34 of a cleaning apparatus as later described into the insertion space S, it becomes possible for the cleaning portion 32 to perform a cleaning operation and for the dusting portion 33 to the cleaning cloth 31, it is also possible to perform a cleaning operation, etc. by putting the user's hand directly into the insertion space S.

[Third Embodiment of Handle of Cleaning Apparatus According to the Present Invention]

FIGS. 13 and 14 show a third embodiment of a handle of a cleaning apparatus according to the present invention. In this embodiment, the cleaning cloth is not attached to the cleaning apparatus. In the illustrations, reference numeral 34 denotes a handle of a cleaning apparatus (hereinafter simply refers to as "handle" in this embodiment).

Figure 13A:
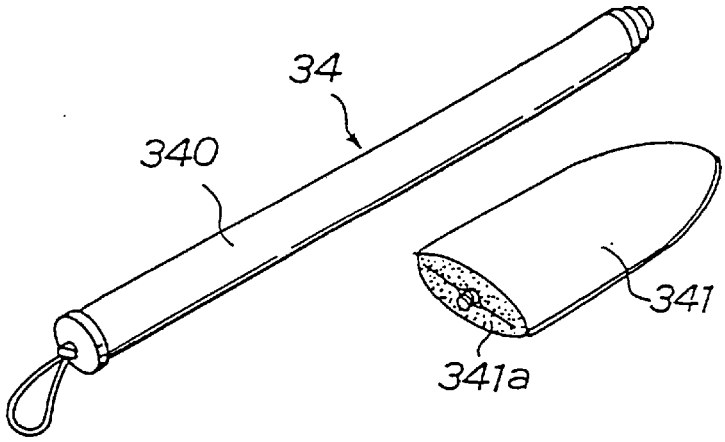
FIG. 13*a*, FIG. 13*b* and FIG. 13*c* are perspective views showing an embodiment of a cleaning apparatus according to the present invention.

As shown in FIG. 13*a*, the handle 34 comprises a handle body 340, and a head 341 to be detachably attached to an end portion of the handle body 340. This head 341 is designed such that the cleaning cloth 32, for example, can be attached thereto.

The handle body 340 chiefly comprises three sleeve-like members 340*a* through 340*c* which have different diameters, respectively. The handle body 340 is expansible and contractible by means of a known expansible/contractible mechanism in which a sleeve-like member having a reduced diameter is longitudinally movably and engageably fitted in a sleeve-like member having an enlarged diameter (see FIGS. 13*b* and 13*c*). A female thread (not shown) is formed in an inner surface of an end portion of the sleeve-like member 340*a*, so that a threaded member 343 of a head 341 as later described can threadingly engage with this female thread. A string 340*d* arranged in a ring-shape is attached to a rear end portion of the handle body 340. The handle body 340 can be hooked on a retaining device such as a hook through the string 340*d*.

Figure 14A:
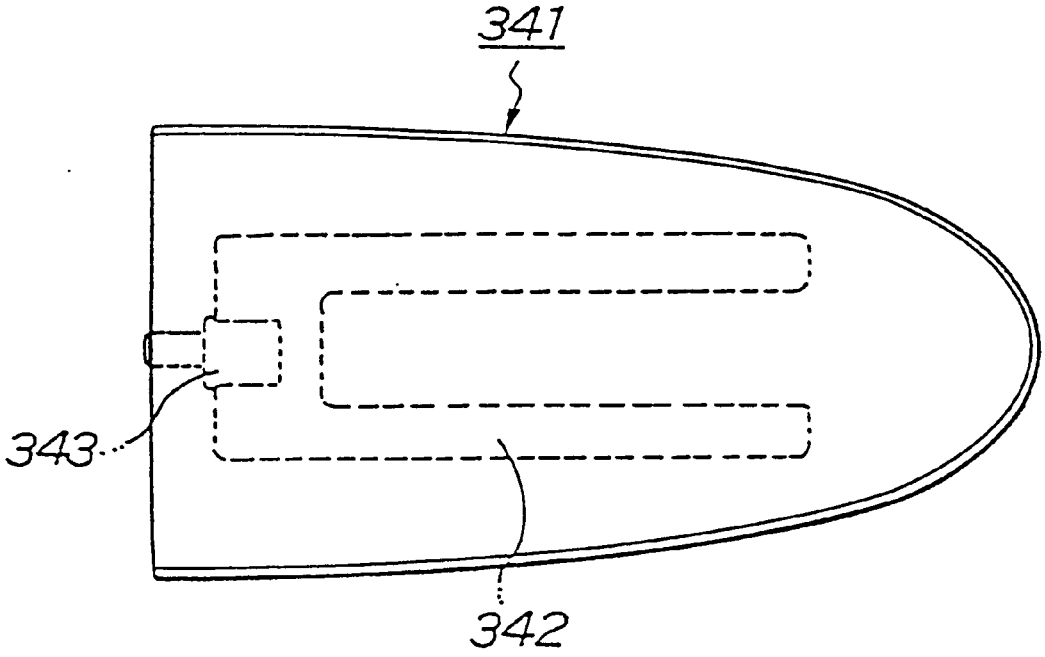
FIG. 14*a* and FIG. 14*b* are views showing a construction of the head of the cleaning apparatus of FIG. 13.
Figure 14B:
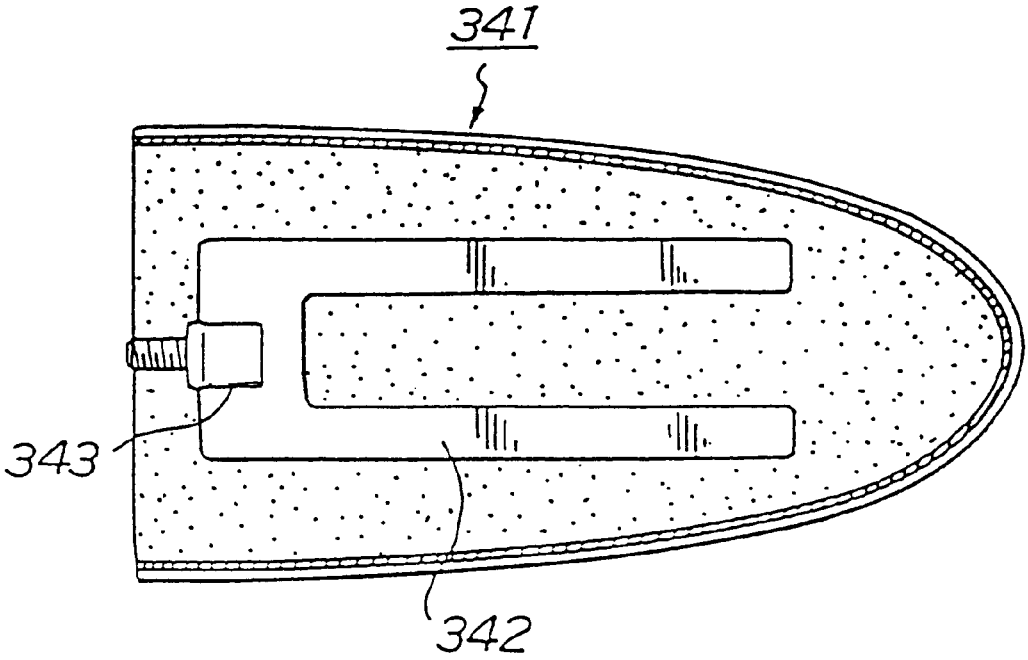

As shown in FIGS. 14*a* and 14*b*, the head 341 has a generally U-shaped configuration in a plan view. The width and the thickness of the head 341 are gradually reduced towards its end. The head 341 is provided at a lower end portion thereof with an opening portion 341*a*. The head 341 is further provided with an insertion portion 343 so that the core member 342 can be inserted therein. The head 341 is made of a foamed ethylene good enough to attach the cleaning cloth thereto. The core member 342 is firmly adhered to the interior of the head 341. The surface of the head 341 is subjected to meltome treatment, so that the cleaning cloth 31 can smoothly be attached and detached.

The core member 342 is formed of a generally U-shaped ABS plate spring (plate-like resilient member) 343 having a male-thread (not shown) formed on its outer periphery is attached to a lower end portion of the core member 342, so that the core member can be threadingly engaged with the end portion of the sleeve-like member 340*a* of the handle body 340.

The handle body 340 of the handle 34 is expansible and contractible. Therefore, the handle body 340 can be expanded in accordance with necessity, and the handle body 340 can be separated from the head 341. Thus, it can be stored in a compact size.

[Fourth Embodiment of Cleaning Apparatus According to the Present Invention]

Figure 15:
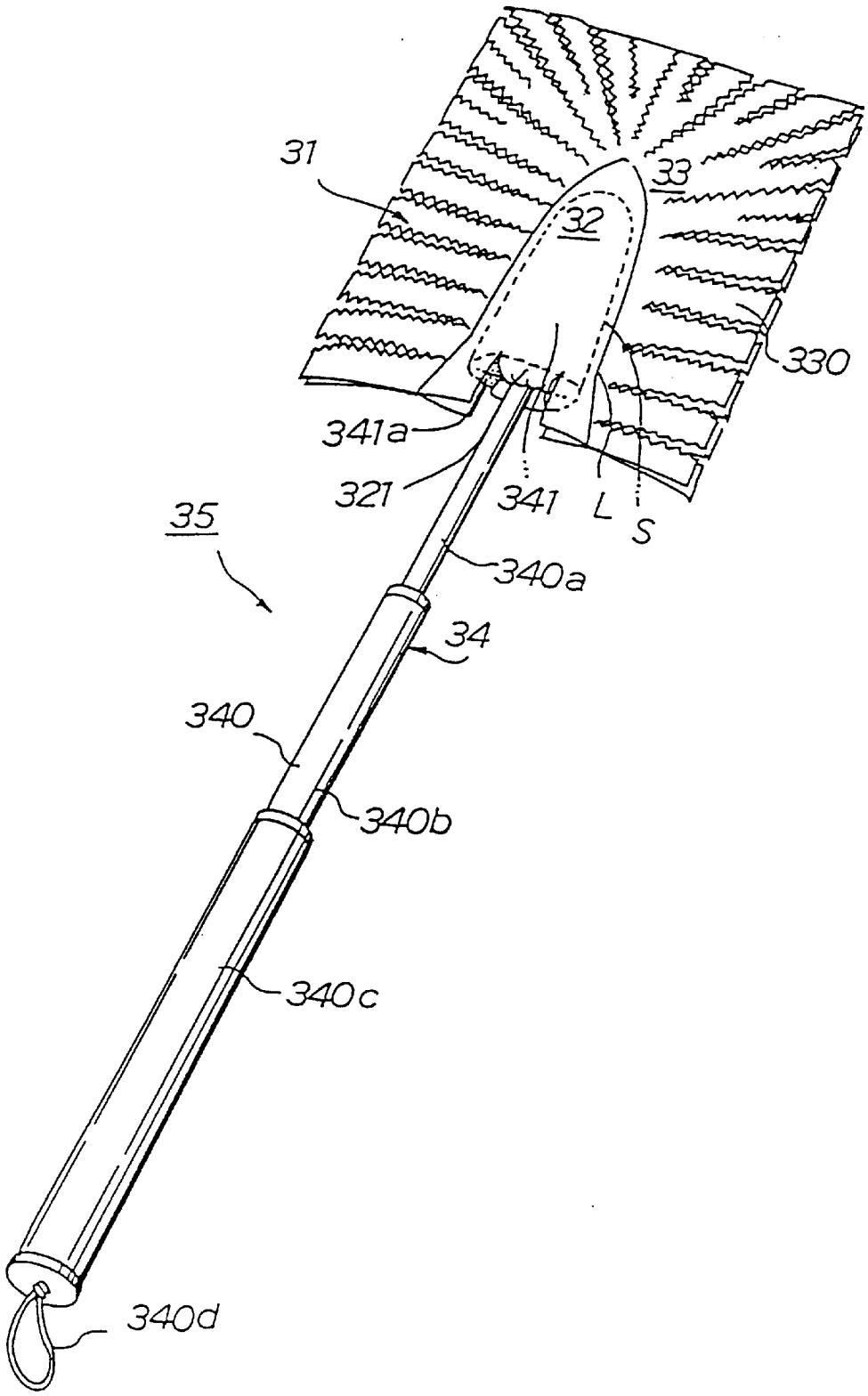
FIG. 15 is a perspective view showing a fourth embodiment of a cleaning apparatus according to the present invention.

FIGS. 15 through 17 show a fourth embodiment of a cleaning apparatus according to the present invention.

The cleaning apparatus of this embodiment comprises the cleaning cloth 31 of the embodiment B shown in FIG. 12, and the handle 34 of the third embodiment shown in FIG. 13.

As shown in FIG. 15, in the cleaning apparatus 35 of this embodiment, the head 341 of the handle 34 is inserted into the insertion space S of the cleaning cloth 31, and the tab 321 is inserted through the opening portion 341*a* of the head 341, thereby securing the cleaning cloth 31 to the head 341.

Figure 13B:
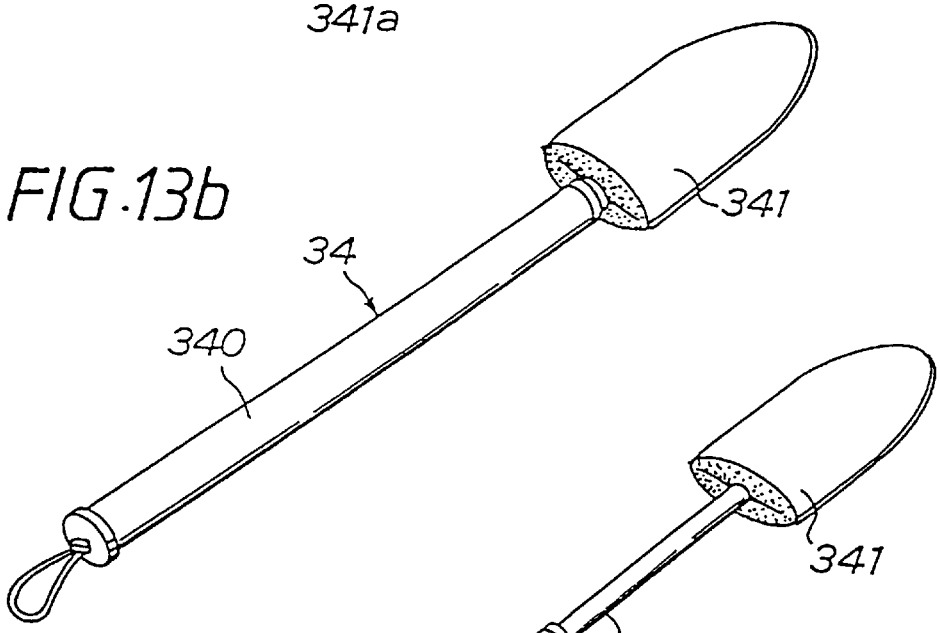
Figure 13C:
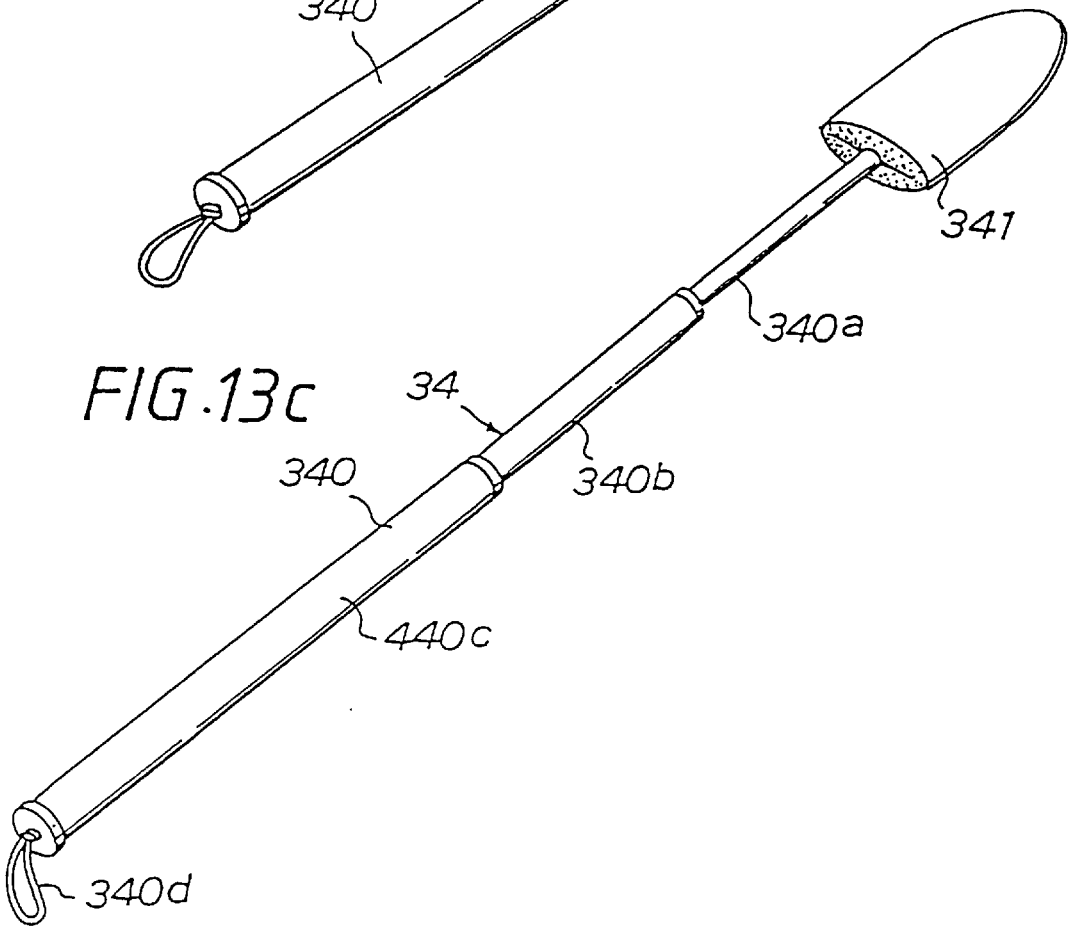
Figure 16A:
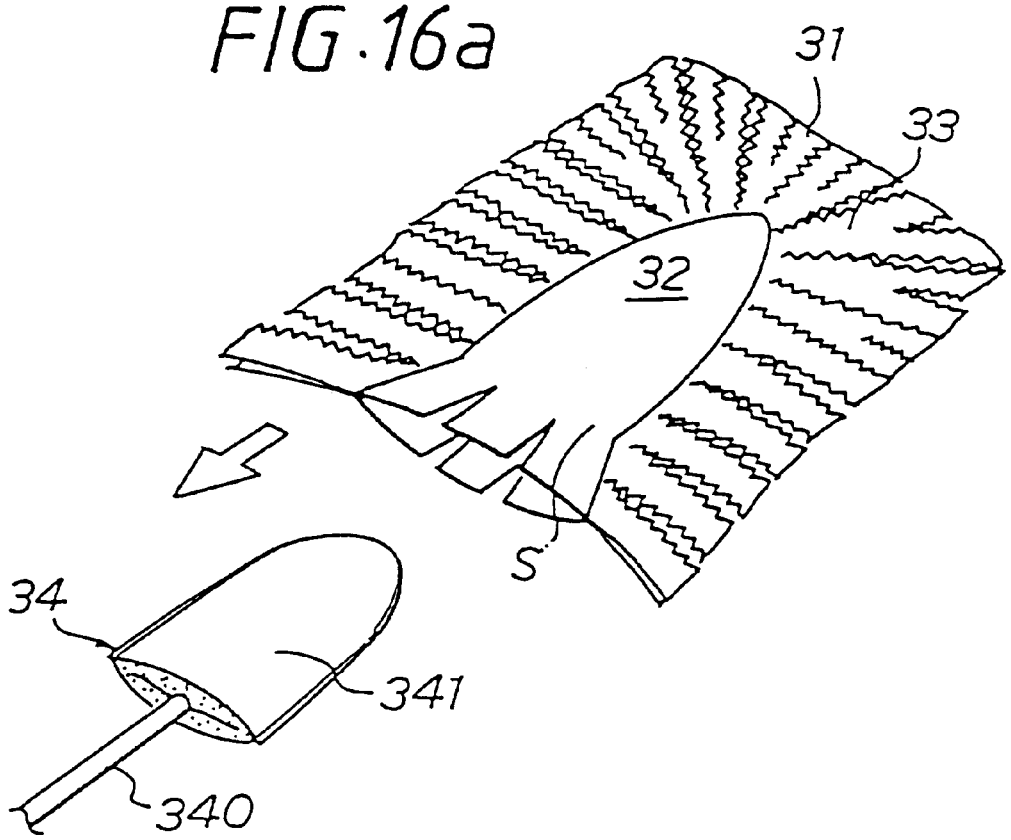
FIG. 16*a* and FIG. 16*b* are views showing the steps of attaching a cleaning cloth in the cleaning apparatus of FIG. 15.
Figure 16B:
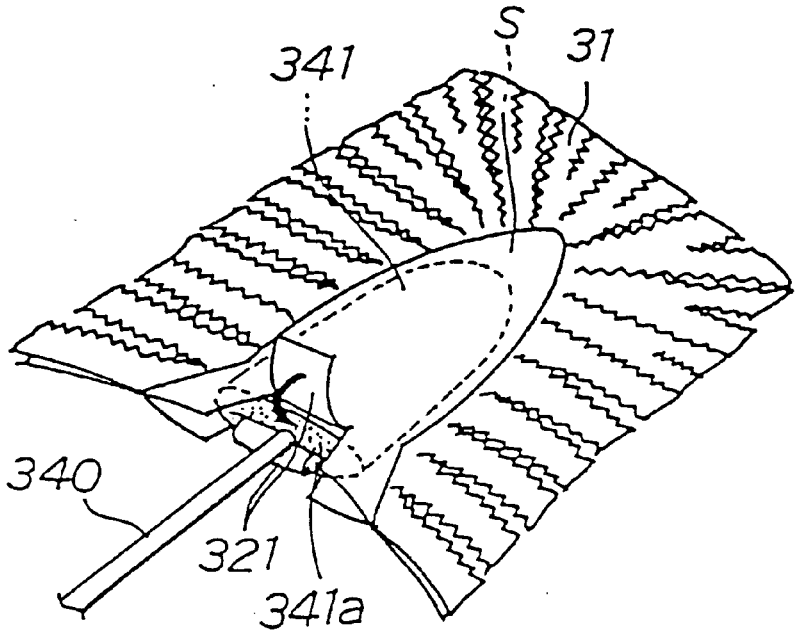

When the cleaning apparatus 35 is used, first, the head 341 is threadingly attached to the handle body 340 to assemble the handle 34 (see FIG. 13*b*). Then, as shown in FIGS. 16*a* and 16*b*, the cleaning cloth 31 is attached to the head 341 in such a manner as to cover the head 341, and the tab 341 is fixedly folded into the opening portion 341*a* of the head 341. By this, the assembling of the cleaning apparatus 35 is completed.

Dust on a table having a comparatively wide area, etc. is cleaned chiefly utilizing the cleaning portion 32 of the cleaning cloth 31. When used as a duster, dust is absorbed utilizing the dusting portion 33. When an area nearby the hand is to be cleaned, the handle 34 is used in its contracted fashion, and when an area at a high location or at an inner space or the like is to be cleaned, the handle 34 is used in its expanded fashion.

Figure 17A:
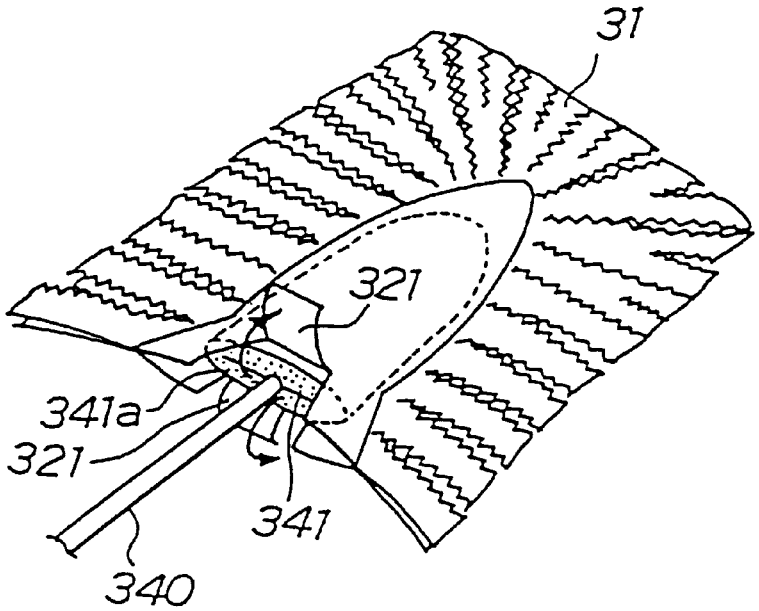
FIG. 17*a* and FIG. 17*b* are views showing the steps for removing a cleaning cloth in the cleaning apparatus of FIG. 15.
Figure 17B:
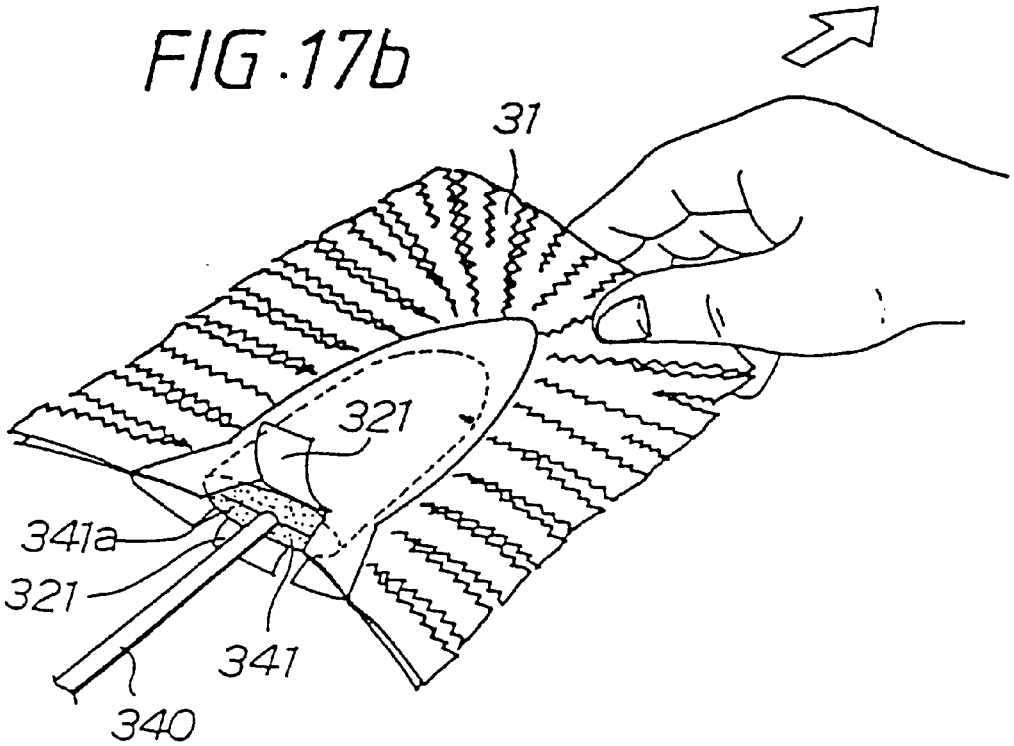

When the cleaning cloth 31 gets very dirty, as shown in FIG. 17*a*, the tab 321 is withdrawn from the opening portion 341*a* of the head 341, and then, as shown in FIG. 17*b*, the cleaning cloth 31 is pulled by picking the end portion thereof, so that the cleaning cloth 31 is separated from the head 341. This cleaning cloth 31 is replaced with another cleaning cloth in accordance with necessity.

As apparent from the above description, since the cleaning apparatus 35 according to this embodiment includes the cleaning portion 32 and the dusting portion 33, a cleaning operation can be performed utilizing the cleaning portion 32 and a dusting operation can be performed utilizing the dusting portion 33. In this way, a wide range of articles such as furniture, electrical equipment, illumination devices, etc. can easily and reliably be cleaned by cleaning and dusting.

Since the cleaning cloth is of a replaceable type and can easily be replaced when it gets dirty, the cleaning cloth can always be used in a sanitary condition.

Since the handle 34 is expansible and contractible, when an area at a high location is required to be cleaned, the handle 34 can be used in its expanded fashion, and when an area nearby the hand is required to be cleaned, the handle 34 can be used in its contracted fashion.

Since the handle 34 and the handle body 340 can be exploded, they are exploded and the handle body 340 is contracted when they are not in use. In this way, the apparatus can be stored in a compact size.

Since the U-shaped spring is disposed within the head 340, an appropriate degree of deflection can be obtained in match with various types of configurations. In addition, since force can be concentrated on the abutting part, a cleaning and a dusting operation can easily be performed.

Since the surface of the head 341 is subjected to meltome treatment, the cleaning cloth 34 can be attached and detached smoothly.

Figure 18:
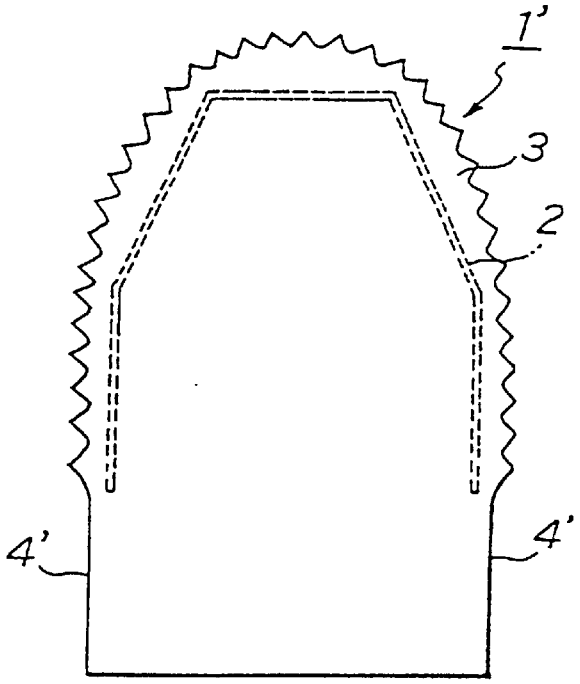
FIG. 18 is a plan view showing an embodiment C of a cleaning cloth according to the present invention.
Figure 19:
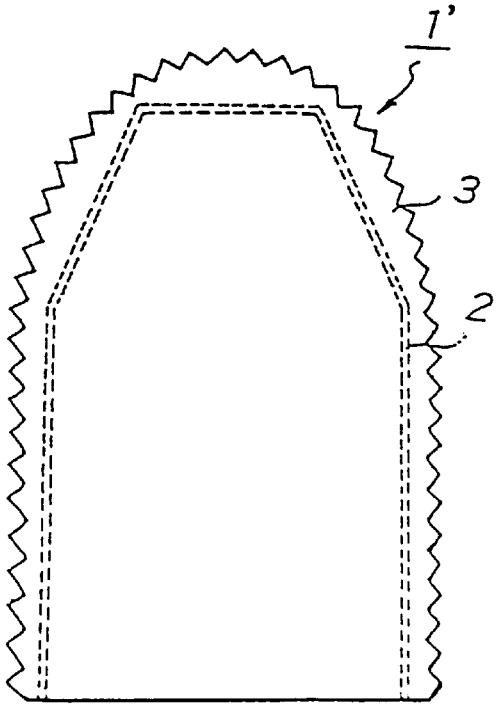
FIG. 19 is a plan view showing an embodiment D of a cleaning cloth according to the present invention.

In the cleaning cloth of the present invention, it is preferred, as in the cleaning cloth 1 of the embodiment A, that the slit 4 is formed at one place of the opening portion of the cleaning cloth 1. However, the slits 4' may be formed at two places as in the cleaning cloth 1' (the embodiment C) shown in FIG. 18, or the slit may be omitted as in the cleaning cloth 1' (the embodiment D) shown in FIG. 19.

Figure 20A:
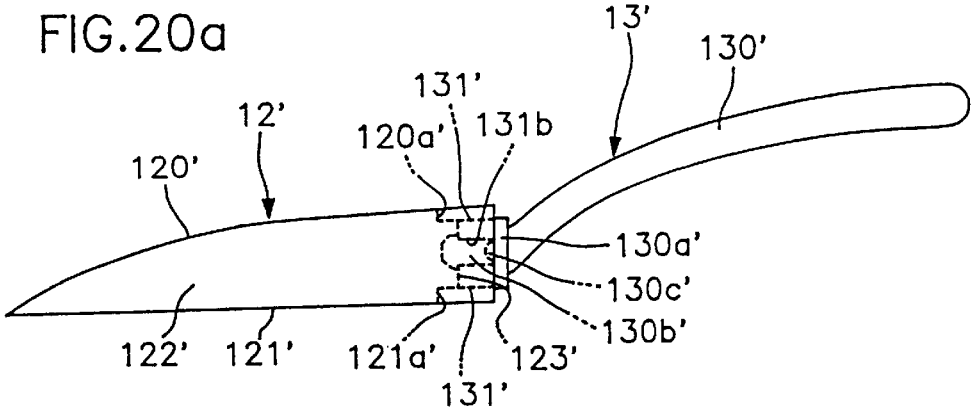
FIG. 20*a* and FIG. 20*b* are views showing a fifth embodiment of a cleaning apparatus according to the present invention.
Figure 20B:
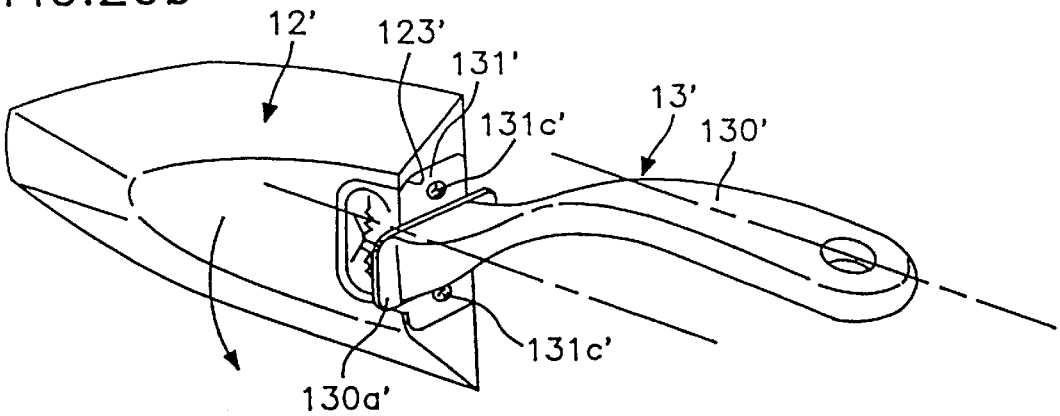
Figure 21:
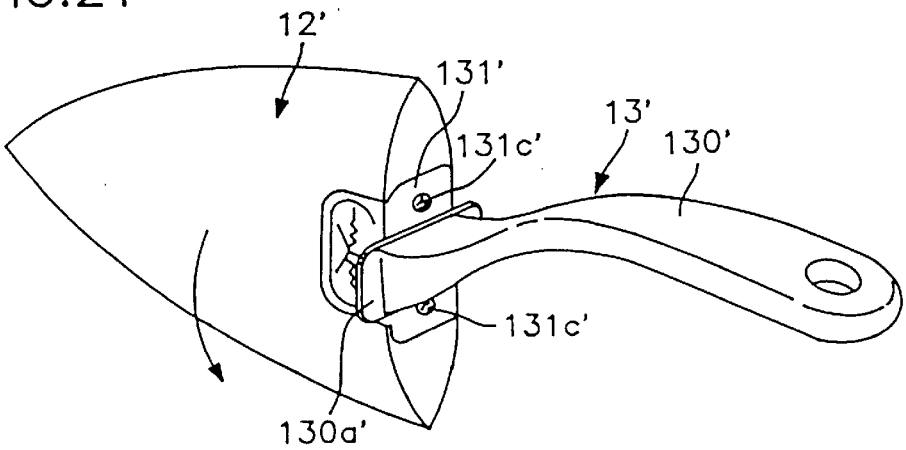
FIG. 21 is a perspective view showing a sixth embodiment of a cleaning apparatus according to the present invention, in which a cleaning cloth is removed and a head portion is being turned with respect to the handle.

As the handle 13' of the cleaning apparatus of the fifth embodiment of FIGS. 20*a* and 20*b*, it may be designed such that a plate portion 130*a'* to be abutted with the attachment portion 131' is formed on an end portion of a handle body 130', a connecting projection 130*b'* is formed at a central portion of this plate portion 130*a'*, engagement projections 130*c'* are formed on both sides of the connecting projections 130*b'*, an insertion hole 131*b'* for inserting the connecting projection 130*b'* therein is formed in the attachment member 131', and an engagement recesses 131*c'* engageable with the engagement projections 130*c'* are formed in both sides of the insertion hole. Owing to this arrangement, the head portion 12' can be turned upside down in the state that the head portion 12' is attached to the attachment member 131'. In case the head portion is designed to be turned upside down, the head portion is also designed to have a convex lens like configuration in section as in the head portion 12' in the handle 13' of the cleaning apparatus of the sixth embodiment of FIG. 21. Owing to this arrangement, a cleaning operation can be performed in the same manner even after the head portion is turned upside down as before the head portion is turned upside down.

For example, in the cleaning apparatus 11 of the above embodiment, the element 130*a* disposed at the end portion of the handle body 130 and the interior of the attachment member 131 may be designed such that the handle body 130 can be attached thereto in its upside down posture. Owing to this arrangement in which the handle body 130 is detached and then attached in its upside down posture to the attachment member 131, the head portion 12 can be turned upside down with respect to the handle body 130.

Figure 22A:
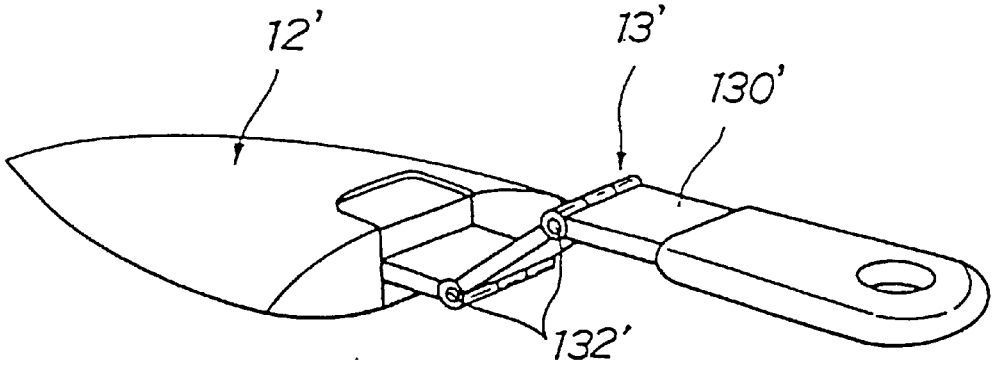
FIG. 22*a*, FIG. 22*b* and FIG. 22*c* are views showing still another embodiment of a cleaning apparatus according to the present invention in which a cleaning cloth is already removed therefrom.
Figure 22B:
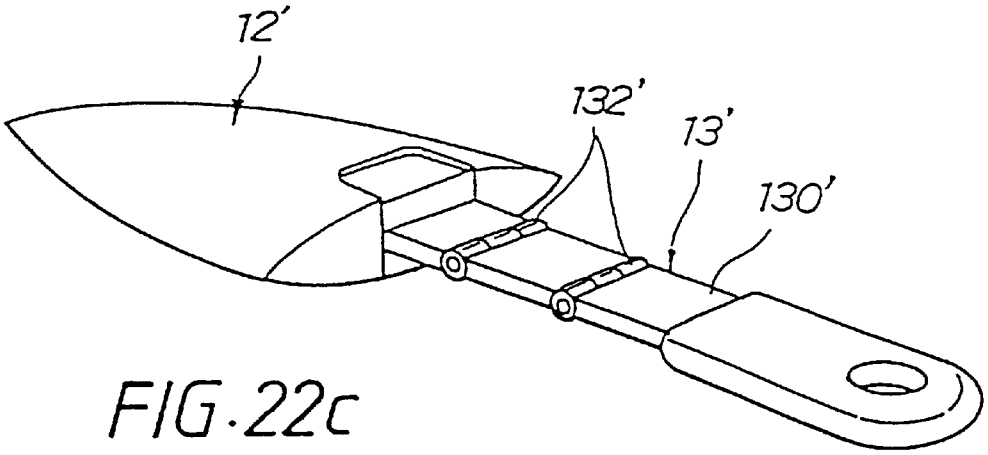
Figure 22C:
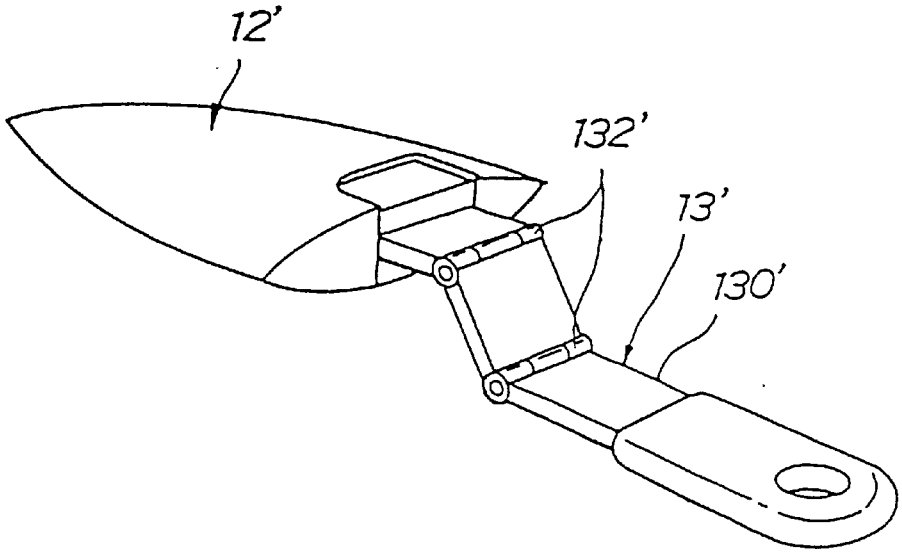

In the handle 13' of the cleaning apparatus 11 of the fifth and sixth embodiments, the head portion 12' is designed to be rotatable with respect to the handle 13', so that the head portion 12' is turned upside down. As the handle of the seventh embodiment shown in FIGS. 22*a* through 22*c*, it may be designed such that a known articulated mechanism, which can be locked to the handle body 130' at a predetermined angle, is employed, and the grip portion of the handle 13' is movable upwardly and downwardly relative to the head portion 12', so that the head 12' is inverted depending on what location is to be cleaned.

Figure 23B:
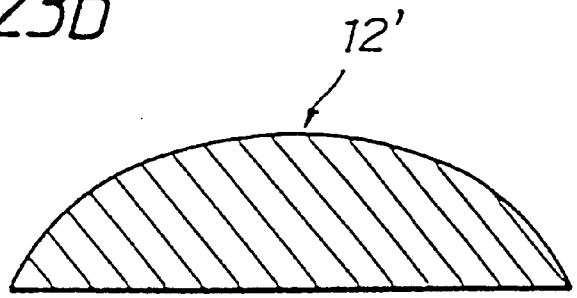
FIG. 23*b*, FIG. 23*c* and FIG. 23*d* are views showing a sectional configuration of a head portion of a cleaning apparatus according to the present invention.
Figure 23C:
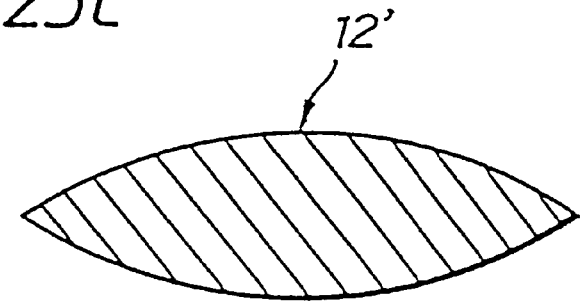
Figure 23D:
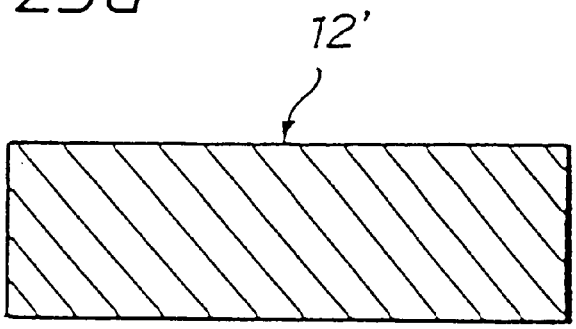

Although the sectional configuration of the head portion is preferably trapezoidal (see FIG. 23*a*) as the head portion of the cleaning apparatus 1 of the first embodiment, it may be a half-moon, convex lens or rectangular configuration in section as the head portion 12' of the cleaning apparatus shown in FIGS. 23*b* through 23*d*.

Figure 24A:
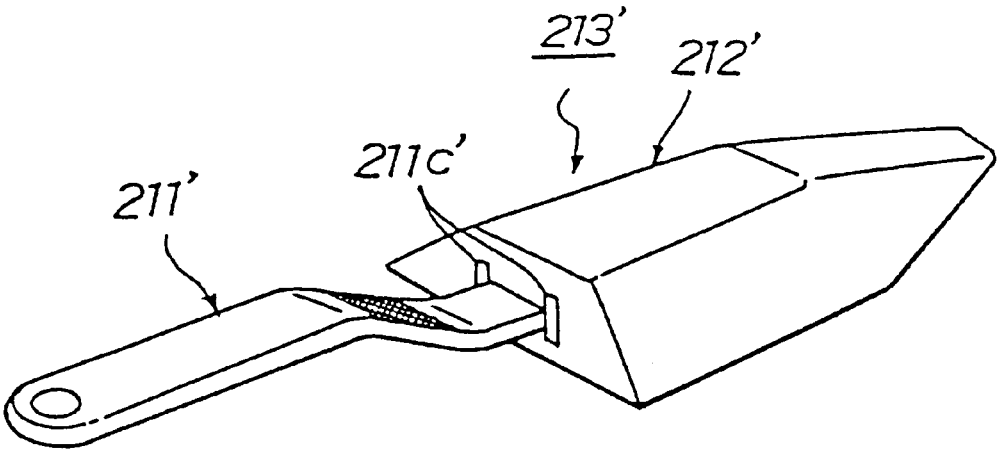
FIG. 24*a* and FIG. 24*b* are views showing an eighth embodiment of a handle in a cleaning apparatus according to the present invention.
Figure 24B:
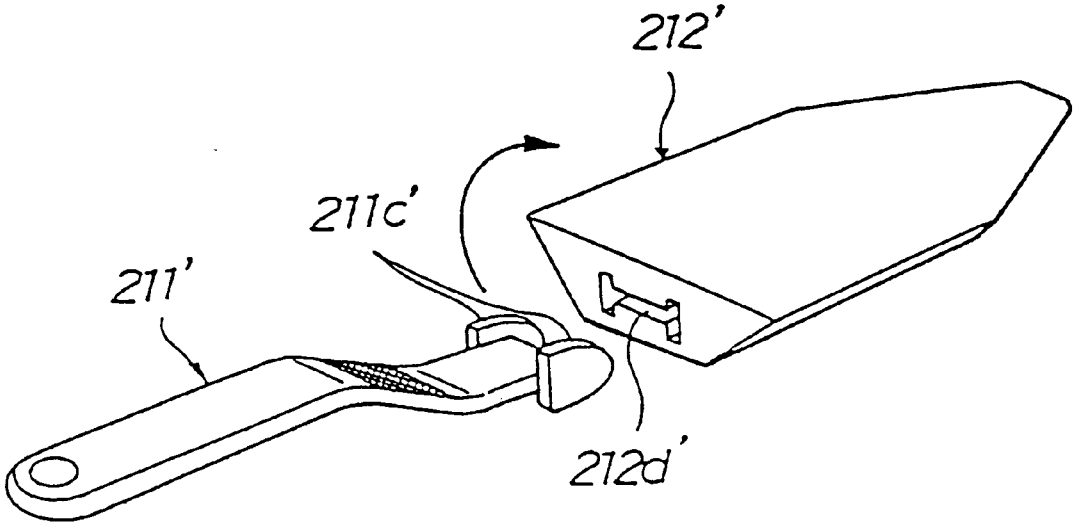

In the cleaning apparatus 210 of the second embodiment, the handle body 211 and the head portion 212 are of a fixed type in which they cannot be attached nor detached. However, it may be designed such that a pair of insertion elements are disposed in such a manner as to be integral with a portion of the handle body 211' to which the head portion is attached as in the handle 213' of the eighth embodiment shown in FIGS. 24*a* and 24*b*, and the head portion 212' is provided with insertion portions 212*d'* corresponding to the insertion elements, so that the handle body 211' and the head portion 212' are attachable and detachable, and attachable in their upside down postures.

Figure 25:
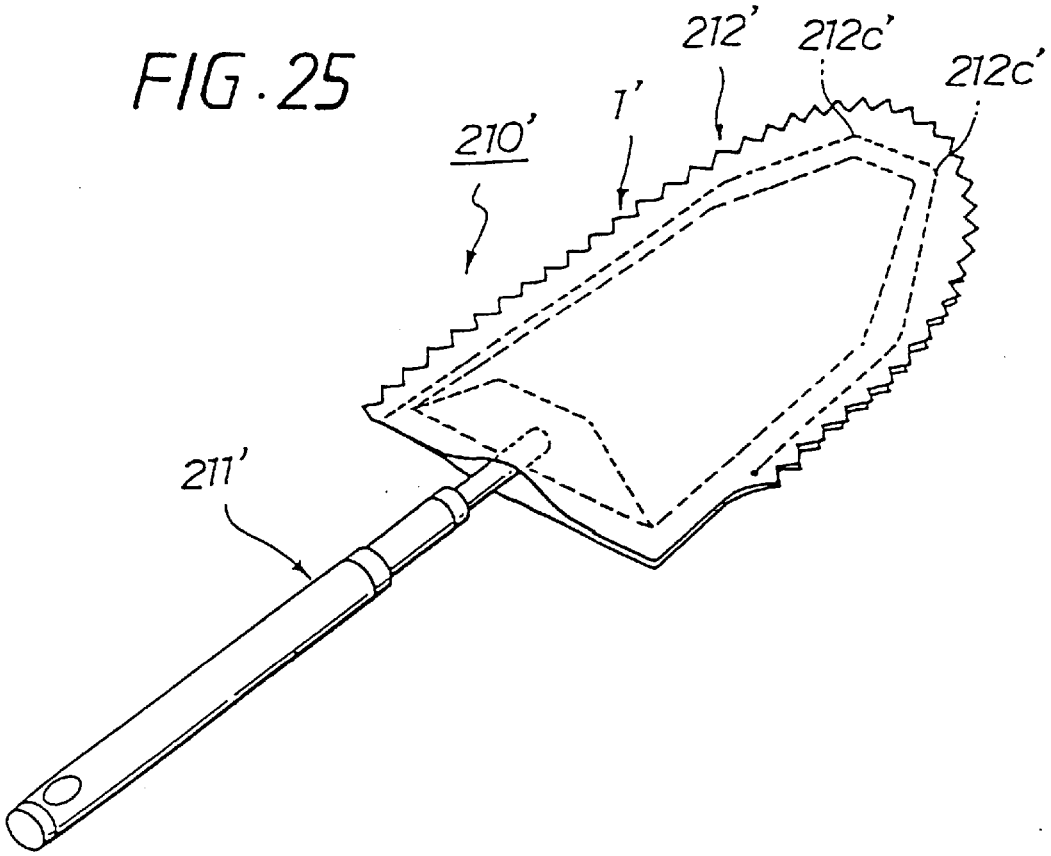
FIG. 25 is a perspective view showing still another embodiment of a cleaning apparatus according to the present invention.

In the cleaning apparatus of the present invention, although it is preferred that the grip portion is higher than that portion of the handle body to which the head portion is attached as in the handle body 211 of the cleaning apparatus 210 of the second embodiment, it may designed such that the handle body chiefly comprises, as in the handle body 211' of the cleaning apparatus 210' of the ninth embodiment shown in FIG. 25, three sleeve-like members having different diameters, and those sleeve-like members are arranged such that a sleeve-like member having a reduced diameter is longitudinally movably and engageably fitted in a sleeve-like member having an enlarged diameter.

Figure 26A:
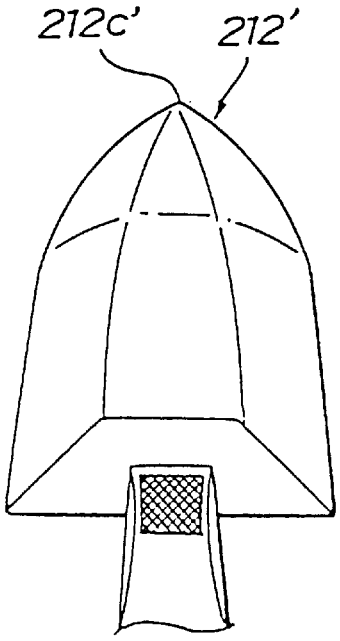
FIG. 26*a* and FIG. 26*b* are views showing still other embodiments of a head portion of a cleaning apparatus according to the present invention.
Figure 26B:
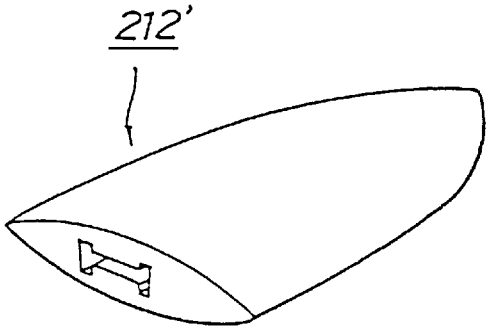

It is preferred that the head portion has a form applicable to a corner portion where dust, etc. tend to stack. It my be designed such that the head portion is provided at an end portion thereof with two angular portions 212*c* as in the head portion 212' of the cleaning apparatus 210' of the second embodiment. Also, it may be designed such that the head portion is provided at one place of its end portion with an angular portion 212*c'* as in the head portion 212' shown in FIG. 26*a*, for example. The head portion may also have a convex lens configuration in section as in the head portion 212' shown in FIG. 26*b*.

Figure 27A:
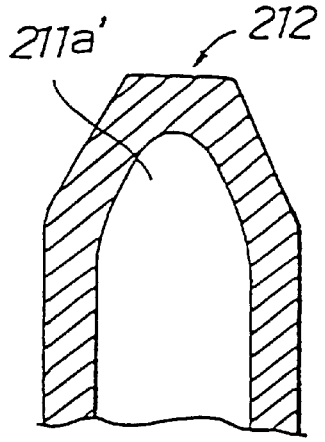
FIG. 27*a*, FIG. 27*b* and FIG. 27*c* are views showing forms of the head portion in a cleaning apparatus according to the present invention and a core member provided in the interior of the head portion.
Figure 27B:
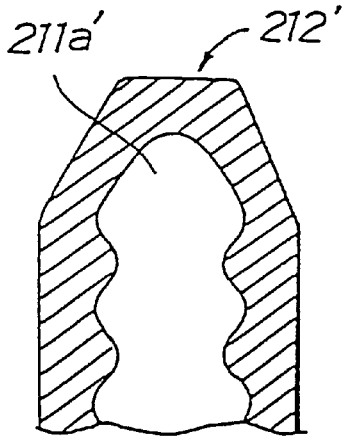
Figure 27C:
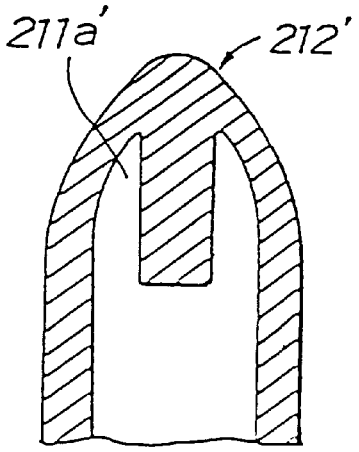
Figure 28A:
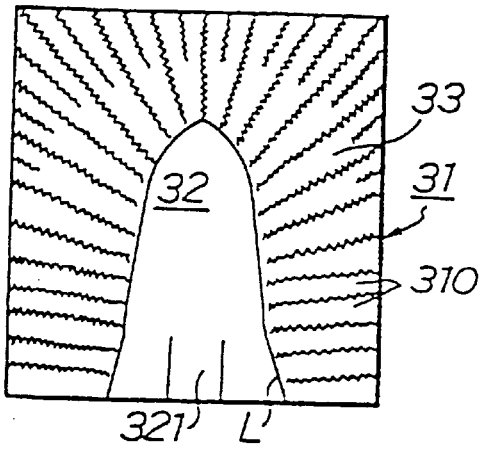
FIG. 28*a*, FIG. 28*b*, FIG. 28*c* and FIG. 28*d* are views showing various embodiments of a cleaning cloth according to the present invention.
Figure 28B:
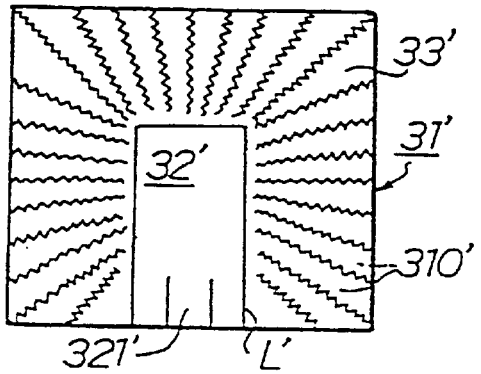
Figure 28C:
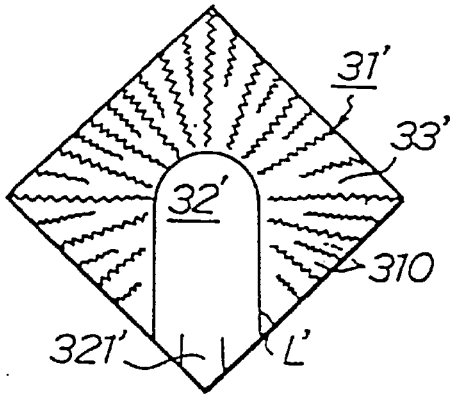
Figure 28D:
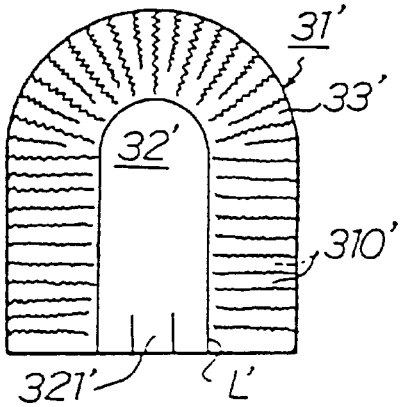

The form of the core member to be arranged within the head portion is not particularly limited. It is preferred, however, that the core member 211*a'* takes on the forms shown in FIGS. 27*a* through 27*c* in plan view.

FIGS. 28*a*, 28*b*, 28*c* and 28*d* are views showing other various embodiments of the cleaning cloth according to the present invention, each of which is a cleaning cloth having a planar cleaning portion composed of a fibrous material and a strap-like or pile-like dusting portion composed of a fibrous material. In the drawings, the cleaning portion is, denoted by reference numerals 32, 32', and the dusting portion is denoted by reference numerals 33, 33'. The cleaning portion of the cleaning cloth shown in FIG. 28 is formed by heat sealing two sheet-like fibrous materials overlaid one on the other so that the cleaning portion may form a bag-like peripheral surface portion having therein an insertion space.

Figure 29B:
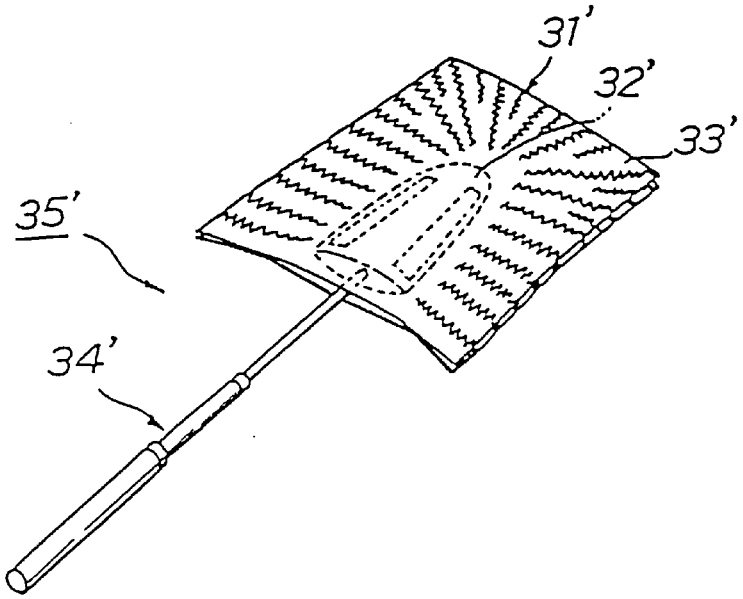

FIG. 29 is a view showing a tenth embodiment of the cleaning apparatus according to the present invention. The cleaning portion of the cleaning cloth in the cleaning apparatus of the tenth embodiment is formed by folding a sheet-like fibrous material to form a bag-like peripheral surface portion having therein an insertion space corresponding to the form of the head portion. Specifically, in the tenth embodiment, as shown in FIG. 29*a*, a single sheet-like fibrous material 310' is folded in half to form the cleaning cloth 31', the folding line of the fibrous material 310' is formed by perforation scores and the fibrous material is folded to be secured to the head portion 341', and therefore the fibrous material 310' is cut along the perforation scores to form the dusting portions 33' at areas located on both sides of the folding line as shown in FIG. 29*b*.

Figure 30A:
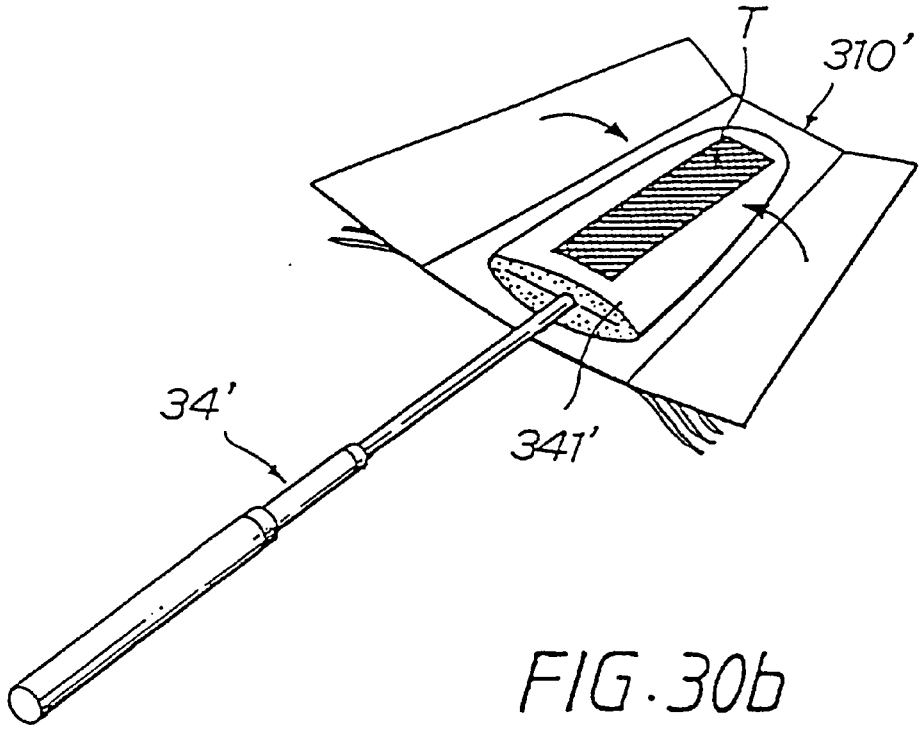
FIG. 30*a* and FIG. 30*b* are views showing an eleventh embodiment of a cleaning apparatus according to the present invention.
Figure 30B:
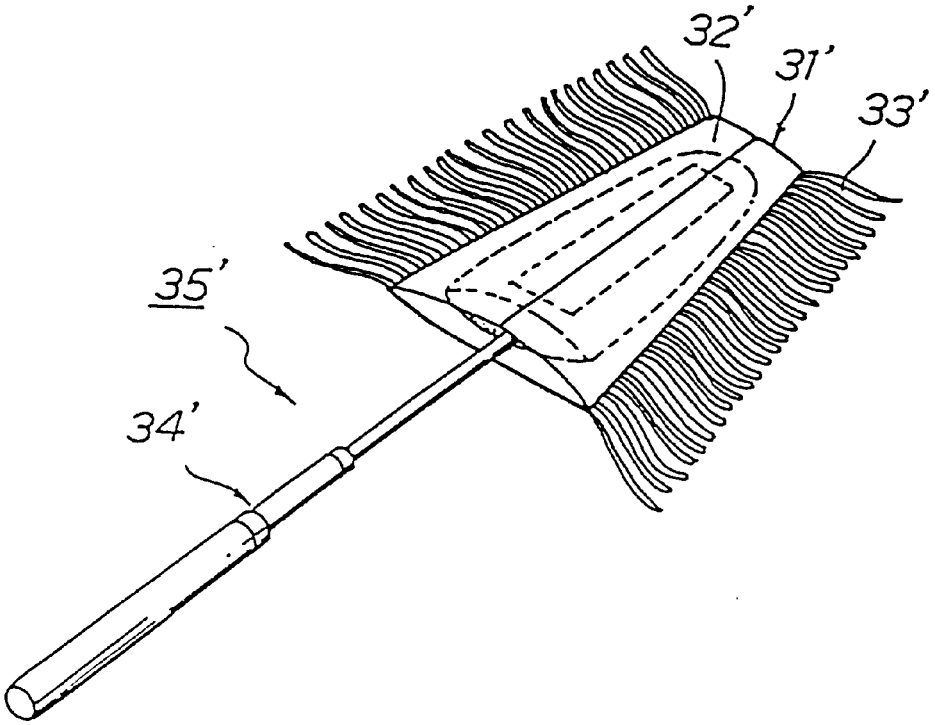

FIG. 30 is a view showing an eleventh embodiment of a cleaning apparatus according to the present invention, FIG. 30*a* is a perspective view of the cleaning apparatus to which the cleaning cloth is not attached yet, and FIG. 30*b* is a perspective view of the cleaning apparatus to which the cleaning cloth is already attached. In the cleaning cloth in the eleventh embodiment, the wire-like fibrous material composing the dusting portion 33' is joined to the sheet-like fibrous material 310' composing the cleaning portion 32' by sewing or heat sealing, so that the dusting portion 33' is arranged on the peripheral edge portion of the cleaning portion 32' as shown in FIG. 30*b*. Thus, the form of the cleaning cloth of the present invention is not limited to the bag-like configuration as long as the cleaning cloth can be attached to the head portion.

Figure 31A:
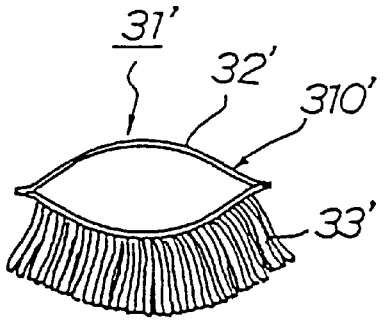
FIG. 31*a*, FIG. 31*b*, FIG. 31*c* and FIG. 31*d* are views showing another embodiment of a cleaning cloth according to the present invention.
Figure 31B:
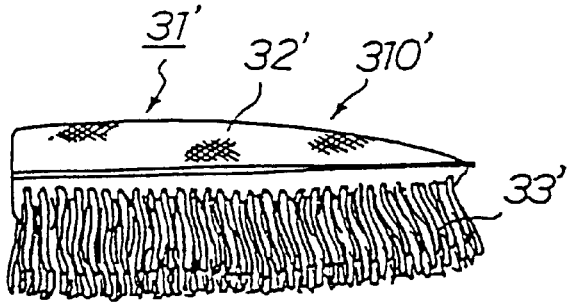
Figure 31C:
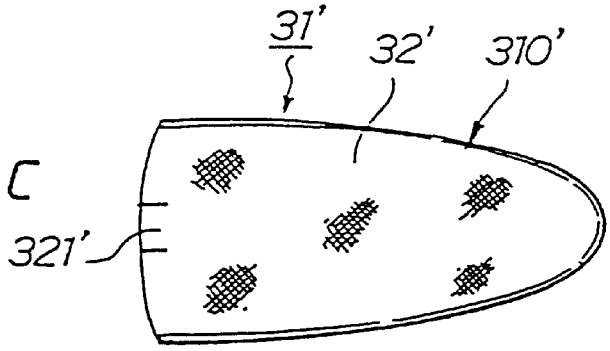
Figure 31D:
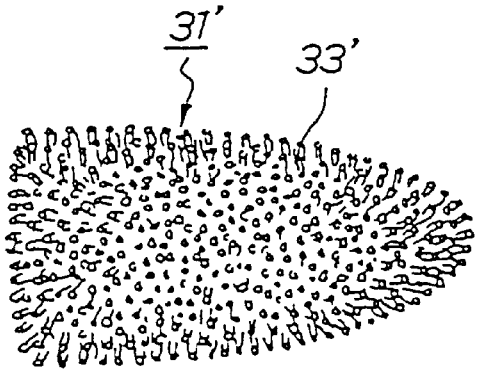

FIG. 31 is a view showing another embodiment of a cleaning cloth according to the present invention, FIG. 31*a* is a back view, FIG. 31*b* is a side view, FIG. 31*c* is a plan view, and FIG. 31*d* is a bottom view. FIG. 32 is a view showing other embodiments of a head of a cleaning apparatus according to the present invention, FIG. 32*a* is a plan view showing one of the embodiments thereof, and FIG. 32*b* is a plan view showing the other one of the embodiments thereof. FIGS. 33*a*, 33*b* and 33*c* are plan views showing various embodiments of a core member provided in the interior of a head portion of a cleaning apparatus according to the present invention.

The cleaning cloth and the cleaning apparatus according to the present invention are not limited to the cleaning cloths of the above-mentioned embodiments A through D and the cleaning apparatuses of the above-mentioned first through eleventh embodiments. They can appropriately be changed in size, shape, material, etc. without departing from the gist and purposes of the present invention. Further, among the above-mentioned embodiments, the cleaning cloths and the handles of the cleaning apparatus (head portions, handle bodies) can be interchanged with their corresponding ones and combined appropriately.

The cleaning cloth and cleaning apparatus according to the present invention, especially any one of the above-mentioned embodiments thereof can exhibit the following advantageous effects.

According to the cleaning cloth of the present invention, a cleaning operation can be performed with its area located at an internal side of the bonded portion and the non-bonded portion can be inserted into a narrow space. Accordingly, it can offer a favorable cleaning operation depending on what area is to be cleaned. Furthermore, since this cleaning cloth is formed like a bag having an insertion space, the end portion of the handle or the like may simply be inserted into the insertion space so as to be ready for performing a cleaning operation. Consequently, no overlapping width is required. Moreover, since both sides of the cleaning cloth can be used by turning it inside out, it is economically efficient. In addition, since the bonded portion is not required to contact the object directly, the object is not damaged by the bonded portion even in the event that a sealing method is employed for bonding.

According to the cleaning apparatus of the present invention, the cleaning cloth is formed like a bag having an insertion space. Accordingly, the cleaning cloth can easily be attached simply by inserting the end portion of the handle, or the like into the insertion space. Consequently, no overlapping width is required. Moreover, since both sides of the cleaning cloth can be used by turning it inside out, it is economically efficient. In addition, since the head portion for attaching the cleaning cloth thereto is made of a soft (or flexible) material, the object is not damaged when the object is cleaned by the cleaning cloth attached to the head portion.

According to the cleaning apparatus of the present invention, the cleaning cloth can easily be attached simply by inserting the head portion into the insertion space, and no overlap width is required. Moreover, since both sides of the cleaning cloth can be used, it is economically efficient. Consequently, no overlapping width is required. Moreover, since both sides of the cleaning cloth can be used by turning it inside out, it is economically efficient. Since the head portion is made of a soft material and the bonded portion is not required to contact the object directly, the object is not damaged by the bonded portion even in the event that a sealing method is employed for bonding. In addition, since the cleaning cloth is capable of performing a cleaning operation with its area located at an internal side of the bonded portion and inserting the non-bonded portion into a narrow space, a favorable cleaning operation is ensured depending on what area is to be cleaned.

According to the cleaning apparatus of the present invention, the opening portion of the cleaning cloth is provided with at least one slit. Accordingly, the cleaning cloth can easily be attached to and detached from the head portion.

According to the cleaning apparatus of the present invention, when the cleaning cloth is detached from the head portion, the inner surface of the cleaning cloth is caught by the catching portion. Accordingly, the cleaning cloth can easily be turned inside out.

According to the cleaning apparatus of the present invention, the head portion is provided at an end portion thereof with an angular portion. Accordingly, a corner portion where dirt and dust are readily stacked can easily be cleaned with this angular portion.

According to the cleaning apparatus of the present invention, the handle body is expansible and contractible. Accordingly, the handle body can be expanded or contracted depending on what area is to be cleaned. In addition, this cleaning apparatus can be stored in its compact size when the cleaning apparatus is to be stored.

According to the cleaning apparatus of the present invention, an object can easily be cleaned with a non-used surface simply by turning the head portion upside down.

According to the cleaning apparatus of the present invention, a core member is arranged within the head. Accordingly, an appropriate rigidity can be applied to the head portion.

According to the cleaning apparatus of the present invention, the end of the head portion, which is readily deformed in accordance with the configuration of an object to be cleaned, is hardly susceptible to fatigue and therefore, it does not become difficult to completely remove dirty things such as dusts, etc., firmly stuck. Moreover, since the head portion has an appropriate hardness and flexibility, a favorable contact with the object to be cleaned is obtained and the object can fully be cleaned. In addition, there is no fear that the object will be damaged and the cleaning cloth will be torn during a cleaning operation.

According to the cleaning apparatus of the present invention, the user can replace the cleaning cloth with a new cleaning cloth without picking up the dirty part of the cleaning cloth after use, and therefore, an easy handling is ensured.

According to the cleaning apparatus of the present invention, the used-surface of the cleaning cloth can easily be switched to the non-used surface in operation by turning the head portion upside down.

According to the cleaning cloth of the present invention, aside from its intrinsic function as a duster utilizing the dusting portion, this cleaning cloth can be used for a cleaning operation utilizing the cleaning (or wiping) portion. Thus, it can widely be used depending on what area is to be cleaned.

According to the cleaning apparatus of the present invention, the head portion for the attachment of the cleaning cloth is made of a resilient material having flexible properties. Accordingly, the object is not damaged when the object is cleaned with the cleaning cloth attached to the head portion.

According to the handle of the cleaning apparatus of the present invention, a core member is arranged within the head. Accordingly, appropriate rigidity can be applied to the head portion.

According to the cleaning apparatus of the present invention, aside from its intrinsic function as a duster utilizing the dusting portion, this cleaning apparatus can be used for a cleaning operation utilizing the cleaning (or wiping) portion. Thus, it can widely be used depending on what area is to be cleaned.

According to the cleaning apparatus of the present invention, the dirty cleaning cloth after use can easily be replaced by detaching the cleaning cloth from the head and replacing it with a new cleaning cloth.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A cleaning cloth having a joined portion formed by joining non-woven fabrics together and having a flat bag-like configuration defining an insertion space in the internal area of said joined portion, wherein a non-joined portion is provided at an external area of said joined portion, the width of said non-joined portion being from 5 mm to 30 mm from the peripheral edge portion of said non-woven fabrics.

2. The cleaning apparatus according to claim 1, wherein said non-joined portion is formed by extended portions being extended from said non-woven fabrics.

3. A cleaning apparatus comprising a handle to be attached to a cleaning cloth and a flat bag-like cleaning cloth having an insertion space therein, said handle being provided with a head portion at an end portion of a handle body, said head portion being inserted into said insertion space thereby attaching said cleaning cloth to said head portion, said cleaning cloth having a joined portion formed by joining non-woven fabrics together, the internal area of said joined portion being provided with said insertion space, and the external area of said joined portion being provided with a non-joined portion, the width of said non-joined portion being from 5 mm to 30 mm from the peripheral edge portion of said non-woven fabrics.

4. The cleaning apparatus according to claim 3, wherein said head portion is provided with a fixing portion for fixing said cleaning cloth thereto.

5. The cleaning apparatus according to claim 3, wherein said handle is provided with a fixing portion for fixing said cleaning cloth thereto.

6. The cleaning apparatus according to claim 3, wherein said head portion is able to be turned upside down in a state that said head portion is attached to said handle.

7. The cleaning apparatus according to claim 3, wherein said head portion is provided at a front end portion of said handle body, and a C-hardness of said head portion is in a range of from 1 to 60 inclusive.

8. A cleaning cloth including a planar cleaning portion comprising a non-woven fabric and a strip-like or pile-like dusting portion comprising a non-woven fabric, said cleaning portion being formed by the top surface and the back surface of a bag portion having an insertion space in the inner portion thereof, and said dusting portion being provided on a peripheral edge portion of said cleaning portion except the portion which forms an opening to said insertion space.

9. The cleaning cloth according to claim 8, wherein said dusting portion is provided on a back surface of said bag portion.

10. A cleaning apparatus having a head portion to which a cleaning cloth is attached, said head portion being provided at a front end portion of a handle, wherein said cleaning cloth includes a planar cleaning portion comprising a non-woven fabric and a strip-like or pile-like dusting portion comprising a non-woven fabric, said cleaning portion being formed by the top surface and the back surface of a bag portion having an insertion space in the inner portion thereof, and said dusting portion being provided on a peripheral edge portion of said cleaning portion except the portion which forms an opening to said insertion space, and said head portion is inserted into said insertion space.

* * * * *